US009469138B1

(12) United States Patent
Ueshima

(10) Patent No.: US 9,469,138 B1
(45) Date of Patent: Oct. 18, 2016

(54) EJECTION ABNORMALITY DETECTION METHOD, AND LIQUID EJECTION DEVICE

(71) Applicant: FUJIFILM Corporation, Tokyo (JP)

(72) Inventor: Masashi Ueshima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/083,350

(22) Filed: Mar. 29, 2016

(30) Foreign Application Priority Data

Mar. 30, 2015 (JP) ..... 2015-069129

(51) Int. Cl.

| | |
|---|---|
| ***B41J 29/393*** | (2006.01) |
| ***B41J 2/21*** | (2006.01) |
| ***B41J 2/165*** | (2006.01) |
| ***B41J 2/045*** | (2006.01) |

(52) U.S. Cl.
CPC ..... *B41J 29/393* (2013.01); *B41J 2/0451* (2013.01); *B41J 2/04558* (2013.01); *B41J 2/16579* (2013.01); *B41J 2/2139* (2013.01); *B41J 2/2142* (2013.01)

(58) Field of Classification Search
CPC .... B41J 2/0451; B41J 2/2139; B41J 2/2142; B41J 2/16579; B41J 2002/165
See application file for complete search history.

(56) References Cited

U.S. PATENT DOCUMENTS

2011/0234673 A1 9/2011 Ueshima
2013/0208042 A1* 8/2013 Ueshima ..... B41J 29/393 347/19

FOREIGN PATENT DOCUMENTS

JP 2005-246650 A 9/2005
JP 2011-201121 A 10/2011

* cited by examiner

*Primary Examiner* — Julian Huffman
(74) *Attorney, Agent, or Firm* — Studebaker & Brackett PC

(57) ABSTRACT

A liquid is ejected which has a volume exceeding a volume for forming a dot of a maximum size used in regular liquid ejection to output a high load pattern, an ejection abnormality detection pattern is output for detecting an ejection element abnormality within a specific period of time from outputting the high load pattern, read data of the output ejection abnormality detection pattern is acquired, and the acquired read data is analyzed to detect an abnormal ejection element.

13 Claims, 23 Drawing Sheets

EJECTION ABNORMALITY DETECTION METHOD, AND LIQUID EJECTION DEVICE

CROSS-REFERENCE TO RELATED APPLICATIONS

The present application claims priority under 35 U.S.C. §119 to Japanese Patent Application No. 2015-069129, filed on Mar. 30, 2015. The above application is hereby expressly incorporated by reference, in its entirety, into the present application.

BACKGROUND OF THE INVENTION

1. Field of the Invention

The present invention relates to an ejection abnormality detection method, and a liquid ejection device, particularly to ejection abnormality detection technology for a liquid ejection head.

2. Description of the Related Art

A liquid ejection head having a plurality of ejection elements is subjected to ejection abnormality detection for detecting an abnormality in the ejection element in order to prevent performance degradation caused by occurrence of the ejection element abnormality. For example, in the ejection abnormality detection, the ejection element abnormality is detected by outputting a test pattern for identifying an abnormalized ejection element and analyzing the output test pattern.

Japanese Patent Application Laid-Open No. 2005-246650 has disclosed a liquid ejection device including a liquid ejection head thereon in which a test pattern constituted by a solid pattern and a ruled line pattern is output, and the test pattern is analyzed to find an abnormal ejection element from a result of solid pattern analysis and find a cause of the abnormality from a result of ruled line pattern analysis.

Terms used herein, that is, a liquid ejection head, a liquid ejection device, an ejection element, and a test pattern correspond to a print head, a print device, a printing element, and a test chart in Japanese Patent Application Laid-Open No. 2005-246650.

Japanese Patent Application Laid-Open No. 2011-201121 (Japanese Patent No. 5433476) describes an inkjet recording apparatus by which a color image is formed on the basis of an image processing flow incorporating an ejection failure correction processing which uses an ejection failure correction table. Note that terms used for the inkjet recording apparatus herein correspond to term used for an inkjet image forming apparatus in Japanese Patent Application Laid-Open No. 2011-201121.

SUMMARY OF THE INVENTION

However, an operation condition of an actual liquid ejection head includes various conditions such as from a low loaded condition to a high loaded condition. The operation condition of the liquid ejection head in outputting the test pattern is similar to a case where the liquid ejection head is operated under the low loaded condition, and an ejection element state in a case where the liquid ejection head is operated under the low loaded condition is reflected to a result of the ejection abnormality detection.

On the other hand, in a case where the liquid ejection head is operated under the high loaded condition, an ejection element in an unstable ejection state and an ejection element having ejection deviation larger as compared with other ejection elements may become abnormal in some cases as well as the ejection element detected through the ejection abnormality detection.

In other words, the ejection elements determined to be abnormal are to increase more in the case where the liquid ejection head is operated under the high loaded condition than in the case where the liquid ejection head is operated under the low loaded condition.

In the test chart described in Japanese Patent Application Laid-Open No. 2005-246650, neither the solid pattern nor the ruled line pattern represent the ejection element state in the case where the liquid ejection head is operated under the high loaded condition and it is difficult to detect an ejection element in which an abnormality may occur in the case where the liquid ejection head is operated under the high loaded condition.

Japanese Patent Application Laid-Open No. 2011-201121, which describes the technology concerning processing on the basis of information on the abnormal ejection element, the invention described in Japanese Patent Application Laid-Open No. 2011-201121 assumes the ejection abnormality detection of related art.

The present invention has been made in consideration of such a circumstance, and has an object to provide an ejection abnormality detection method, and liquid ejection device capable of detecting an ejection element in which an abnormality may occur in the case where the liquid ejection head is operated under the high loaded condition.

In order to achieve the above object, the following aspects are provided.

An ejection abnormality detection method according to a first aspect is an ejection abnormality detection method including a high load pattern outputting step of ejecting a liquid which has a volume exceeding a volume for forming a dot of a maximum size used in regular liquid ejection to output a high load pattern, an ejection abnormality detection pattern outputting step of outputting an ejection abnormality detection pattern for detecting an ejection element abnormality within a specific period of time from outputting the high load pattern in the high load pattern outputting step, a read data acquiring step of acquiring read data of the ejection abnormality detection pattern output in the ejection abnormality detection pattern outputting step, and an analyzing step of analyzing the read data acquired in the read data acquiring step to detect an abnormal ejection element.

According to the first aspect, in the ejection abnormality detection of a liquid ejection head, outputting of the high load pattern and outputting of the ejection abnormality detection pattern within a specific period of time from outputting the high load pattern make it possible to bring an ejection state of the liquid ejection head into a simulative high loaded condition in outputting the ejection abnormality detection pattern, and to extract an unstable ejection element as an abnormal ejection element in which an abnormality does not occur under a low loaded condition but occurs under a high loaded condition.

The regular liquid ejection is liquid ejection on the basis of ejection data, and an ejection volume may be possibly limited depending on a type of medium or a type of liquid to be used.

An aspect may be adopted in which the ejection abnormality detection pattern is output immediately after outputting the high load pattern, within a specific period of time from outputting the high load pattern, and the high load pattern and the ejection abnormality detection pattern are arranged at locations adjacent to each other. The locations adjacent to each other are in a range in which action and effect can be obtained owing to outputting the high load pattern described above, may be apart from each other by one dot or more, and may be apart by several dots.

A second aspect may have a configuration in which, in the ejection abnormality detection method according to the first aspect, in the ejection abnormality detection pattern outputting step, the ejection abnormality detection pattern is successively output plural times, and in the analyzing step, a part or all of the read data of a plurality of ejection abnormality detection patterns output in the ejection abnormality detection pattern outputting step are analyzed.

According to the second aspect, a number of pieces of the read data to be analyzed is increased so as to be able to expect improvement in reliability of the ejection abnormality detection. On the other hand, the number of pieces of the read data to be analyzed is decreased to be able to reduce a processing period in the ejection abnormality detection.

A third aspect may have a configuration in which, in the ejection abnormality detection method according to the first or second aspect, in the high load pattern outputting step, the high load pattern is constituted by a dot formed of a liquid having a volume of 60% or more of a maximum ejection volume which can be ejected from a liquid ejection head that is an object of ejection abnormality detection.

According to the third aspect, a preferable simulative high loaded condition can be achieved in outputting the ejection abnormality detection pattern.

For the ejection in outputting the high load pattern, the aspect may be adopted in which the liquid is ejected for forming one dot in one time or the aspect may be adopted in which the liquid is ejected for forming one dot in plural times.

A fourth aspect may have a configuration in which, in the ejection abnormality detection method according to any one of the first to third aspect, in the high load pattern outputting step, the high load pattern is constituted by a dot formed of a liquid having a volume of 1.25 times or more the liquid having the volume for forming the dot of the maximum size used in the regular liquid ejection.

According to the fourth aspect, a preferable simulative high loaded condition can be achieved in outputting the ejection abnormality detection pattern.

The dot of the maximum size used in the regular liquid ejection is determined depending on the ejection resolution.

A fifth aspect may have a configuration in which, in the ejection abnormality detection method according to any one of the first to fourth aspects, in the analyzing step, the high load pattern is not an object of analysis, and the ejection abnormality detection pattern is an object of analysis.

According to the fifth aspect, the high load pattern does not have a function to detect one missing dot by the high load pattern analysis, and thus, it is possible that the high load pattern is not an object of analysis.

In other words, the high load pattern is different in the function from a uniform density pattern for detecting one missing dot.

The aspect in which the high load pattern is not an object of analysis includes an aspect in which the high load pattern is not an object of reading.

A sixth aspect may have a configuration in which, in the ejection abnormality detection method according to any one of the first to fifth aspects, in the high load pattern outputting step, in a case where plurality of liquid ejection heads are objects of ejection abnormality detection, the high load pattern of each of the plural liquid ejection heads is output to the same region on a medium.

According to the sixth aspect, a region of a medium to which the high load pattern is output is expected to reduce.

A seventh aspect may have a configuration in which, in the ejection abnormality detection method according to any one of the first to fifth aspects, in the high load pattern outputting step, in a case where plurality of liquid ejection heads are objects of ejection abnormality detection, the high load pattern of each of the plural liquid ejection heads is output to a different region on a medium.

According to the seventh aspect, it is possible to bring ejection control of a plurality of inkjet heads and conveyance control of the medium into a common control in outputting the ejection abnormality detection test pattern including the high load pattern and the ejection abnormality detection pattern.

An eighth aspect may have a configuration in which, the ejection abnormality detection method according to any one of the first to seventh aspects, further comprises an elapsed time period determination step of determining whether or not an elapsed time period from outputting of a previous high load pattern exceeds a predefined regulation time period, in which in the high load pattern outputting step, in a case where the elapsed time period from outputting of the previous high load pattern is determined to exceed the predefined regulation time period in the elapsed time period determination step, the high load pattern is output.

According to the eighth aspect, the simulative high loaded condition in outputting the ejection abnormality detection pattern is reliably reproduced.

A ninth aspect may have a configuration in which, the ejection abnormality detection method according to any one of the first to seventh aspects, further comprises an elapsed time period determination step of determining whether or not an elapsed time period from outputting of a previous high load pattern exceeds a predefined regulation time period, in which in the ejection abnormality detection pattern outputting step, in a case where the elapsed time period from outputting of the previous high load pattern is determined to be the predefined regulation time period or less in the elapsed time period determination step, the ejection abnormality detection pattern is output, in the high load pattern outputting step, in a case where the elapsed time period from outputting of the previous high load pattern is determined to exceed the predefined regulation time period in the elapsed time period determination step, the high load pattern is output, and in a case where the elapsed time period from outputting of the previous high load pattern is determined to be the predefined regulation time period or less in the elapsed time period determination step, the high load pattern is output after the ejection abnormality detection pattern outputting step.

According to the ninth aspect, the simulative high loaded condition in outputting the ejection abnormality detection pattern is reliably reproduced particularly in outputting the ejection abnormality detection pattern successively to a plurality of sheets of medium.

A tenth aspect may have a configuration in which, the ejection abnormality detection method according to any one of the first to ninth aspects, in the ejection abnormality detection pattern outputting step, the ejection abnormality detection pattern is output to the same medium as the medium to which the high load pattern is output in the high load pattern outputting step.

According to the tenth aspect, outputting of the high load pattern immediately before outputting the ejection abnormality detection pattern makes it possible to bring the ejection state of the liquid ejection head into a simulative high loaded condition in outputting the ejection abnormality detection pattern.

An eleventh aspect may have a configuration in which, the ejection abnormality detection method according to any one of the first to ninth aspects, in ejection abnormality detection pattern outputting step, the ejection abnormality detection pattern is output to a medium immediately following the medium to which the high load pattern is output in the high load pattern outputting step.

According to the eleventh aspect, in a case where the liquid ejection is successively carried out, the high load pattern is output to the medium to which the ejection abnormality detection pattern has not been output such that the high load pattern can be output immediately before outputting the ejection abnormality detection pattern.

A liquid ejection device according to a twelfth aspect is a liquid ejection device including a liquid ejection head provided with ejection element for ejecting a liquid, a high load pattern data generation device which ejects a liquid that has a volume exceeding a volume for forming a dot of a maximum size used in regular liquid ejection to generate high load pattern data in outputting a high load pattern, an ejection abnormality detection pattern data generation device which generates ejection abnormality detection pattern data in outputting an ejection abnormality detection pattern for detecting an ejection element abnormality, a read data acquisition device which acquires read data of the ejection abnormality detection pattern output from the liquid ejection head, an analysis device which analyzes the read data acquired by the read data acquisition device to detect an abnormal ejection element, and an ejection control device which controls liquid ejection of the liquid ejection head on the basis of the high load pattern data generated by the high load pattern data generation device in outputting the high load pattern from the liquid ejection head, and controls liquid ejection of the liquid ejection head on the basis of the ejection abnormality detection pattern data generated by the ejection abnormality detection pattern data generation device within a specific period of time from outputting the high load pattern in outputting the ejection abnormality detection pattern from the liquid ejection head.

According to the twelfth aspect, an action and effect the same as the first aspect can be obtained.

In the twelfth aspect, matters similar to those specified in the second to eleventh aspects can be appropriately combined. The steps performing processes or functions specified in the ejection abnormality detection method may be grasped as components of devices for the corresponding processes and operations.

A thirteenth aspect is a non-transitory tangible computer-readable recording medium including an ejection abnormality detection program for a liquid ejection device which includes a liquid ejection head provided with an ejection element for ejecting a liquid, stored thereon, the program causing a computer to function as, a high load pattern data generation device which ejects a liquid that has a volume exceeding a volume of a liquid for forming a dot of a maximum size used in regular liquid ejection to generate high load pattern data in outputting a high load pattern, an ejection abnormality detection pattern data generation device which generates ejection abnormality detection pattern data in outputting an ejection abnormality detection pattern for detecting an ejection element abnormality, a read data acquisition device which acquires read data of the ejection abnormality detection pattern output from the liquid ejection head, an analysis device which analyzes the read data acquired by the read data acquisition device to detect an abnormal ejection element, and an ejection control device which controls liquid ejection of the liquid ejection head on the basis of the high load pattern data generated by the high load pattern data generation device in outputting the high load pattern from the liquid ejection head, and controls liquid ejection of the liquid ejection head on the basis of the ejection abnormality detection pattern data generated by the ejection abnormality detection pattern data generation device within a specific period of time from outputting the high load pattern in outputting the ejection abnormality detection pattern from the liquid ejection head.

According to the thirteenth aspect, an action and effect the same as the first and twelfth aspects can be obtained.

In the thirteenth aspect, matters similar to those specified in the second to eleventh aspects can be appropriately combined. The steps performing processes or functions specified in the ejection abnormality detection method may be grasped as components of devices for the corresponding processes and operations.

According to the present invention, in the ejection abnormality detection of a liquid ejection head, outputting of the high load pattern and outputting of the ejection abnormality detection pattern within a specific period of time from outputting the high load pattern make it possible to bring an ejection state of the liquid ejection head into a simulative high loaded condition in outputting the ejection abnormality detection pattern, and to extract an unstable ejection element as an abnormal ejection element in which an abnormality does not occur under a low loaded condition but occurs under a high loaded condition.

DETAILED DESCRIPTION OF THE EMBODIMENTS

Hereinafter, a description is given of the preferred embodiments of the present invention in detail with reference to the attached drawings.

First Embodiment

Outline of Ejection Abnormality Detection

Figure 1:
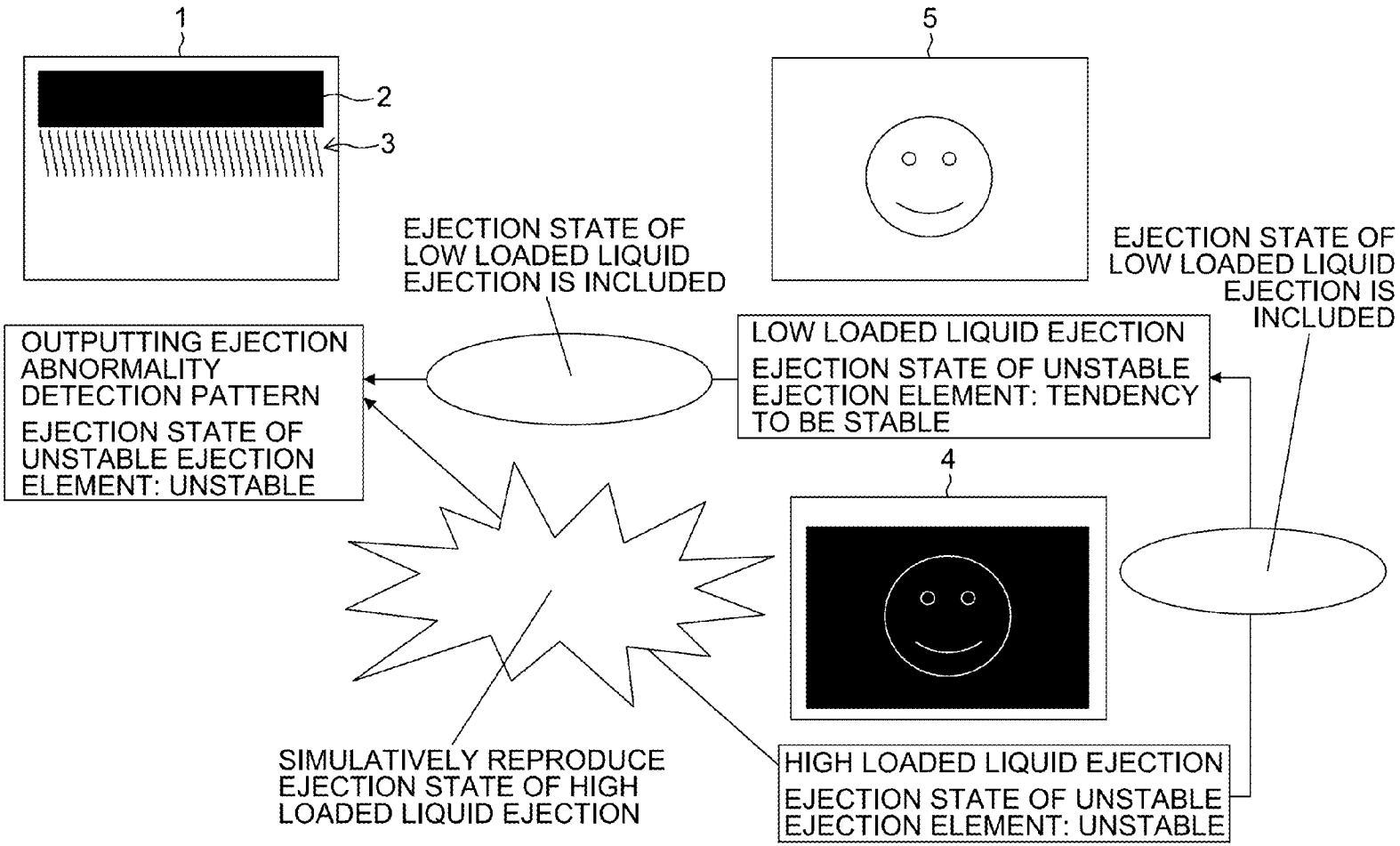
FIG. 1 is a schematic diagram showing an outline of an ejection abnormality detection method according to an embodiment of the invention.

FIG. 1 is a schematic diagram showing an outline of an ejection abnormality detection method according to an embodiment of the invention. The ejection abnormality detection method illustrated in the embodiment is applied to an inkjet recording apparatus including an inkjet head.

An ink is an aspect of a liquid. The inkjet head is an aspect of a liquid ejection head. The inkjet recording apparatus is an aspect of a liquid ejection device.

In outputting an ejection abnormality detection test pattern shown in FIG. 1 and designated by reference numeral 1, an ejection abnormality detection test pattern with high load pattern is output from an inkjet head that is an object of ejection abnormality detection not shown in FIG. 1.

Figure 21:
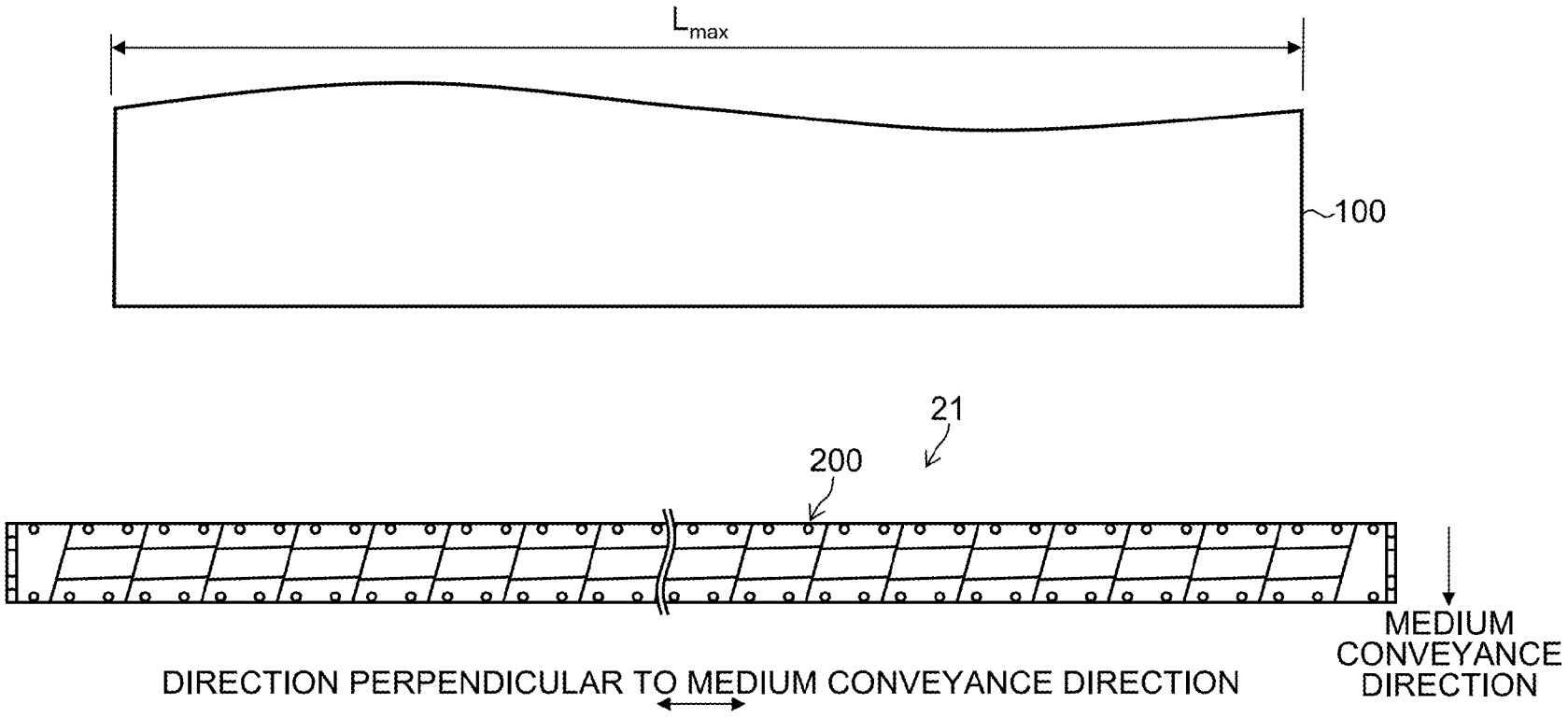
FIG. 21 is a perspective plan view showing a structural example of an inkjet head.

In outputting the ejection abnormality detection test pattern with high load pattern, first, a high load pattern 2 is output, and, within a specific period of time from outputting the high load pattern 2, an ejection abnormality detection pattern 3 is output from an inkjet head that is an object of ejection abnormality detection. The inkjet head is shown in FIG. 21 and designated by reference numeral 21.

The high load pattern 2 shown in FIG. 1 is output with the inkjet head being operated under a high loaded condition further higher than a high loaded condition in normal image forming processing. The high load pattern 2 is described later in detail.

Outputting the high load pattern 2 from the inkjet head that is the object of ejection abnormality detection allows to simulatively reproduce an ejection state of when the inkjet head is operated under the high loaded condition in the normal image forming processing, shown in the figure and designated by reference numeral 4, on outputting the ejection abnormality detection pattern 3, such that the ejection abnormality detection pattern 3 is output in an ejection state the same as the ejection state of when the inkjet head is operated under the high loaded condition in the normal image forming processing.

In outputting the ejection abnormality detection pattern 3, an ejection condition is adopted of when the inkjet head is operated under a low loaded condition, shown in the figure and designated by reference numeral 5. When the inkjet head is operated under the low loaded condition, shown in the figure and designated by reference numeral 5, an ejection element in an unstable ejection state or an ejection element in which ejection deviation is prone to occur is in a state where an abnormality unlikely to occur, that is, it can be said that the ejection element in an unstable ejection state or the ejection element in which the ejection deviation is prone to occur tends to be stable.

Note that, in FIG. 1, the ejection element in an unstable ejection state or the ejection element in which the ejection deviation is prone to occur is described as the unstable ejection element.

The ejection state of the inkjet head within a specific period of time from outputting the high load pattern 2 is under a simulative high loaded condition where an abnormality likely to occur in the ejection element in an unstable ejection state or the ejection element in which the ejection deviation is prone to occur, and thus, the possibility becomes high that the ejection element in an unstable ejection state or the ejection element in which the ejection deviation is prone to occur is extracted.

In other words, outputting the high load pattern 2 and outputting the ejection abnormality detection pattern 3 within a specific period of time from outputting the high load pattern 2 allow to simulatively reproduce the ejection state of the inkjet head of when the inkjet head is operated under the high loaded condition in the normal image forming processing, which ejection state includes the ejection state of when the inkjet head is operated under the low loaded condition, and thus, an abnormality becomes likely to occur in the ejection element in an unstable ejection state or the ejection element in which the ejection deviation is prone to occur, and the possibility becomes high that the ejection element in an unstable ejection state or the ejection element in which the ejection deviation is prone to occur is extracted.

Examples of the preferred embodiment of "within a specific period of time from outputting the high load pattern 2" include an aspect in which the ejection abnormality detection pattern 3 is output immediately after outputting the high load pattern 2, and the high load pattern 2 and the ejection abnormality detection pattern 3 are arranged at locations adjacent to each other. The locations adjacent to each other are in a range in which action and effect can be obtained owing to outputting the high load pattern 2 described above, may be apart from each other by one dot or more, and may be apart by several dots.

<Description of Flowchart>

Figure 2:
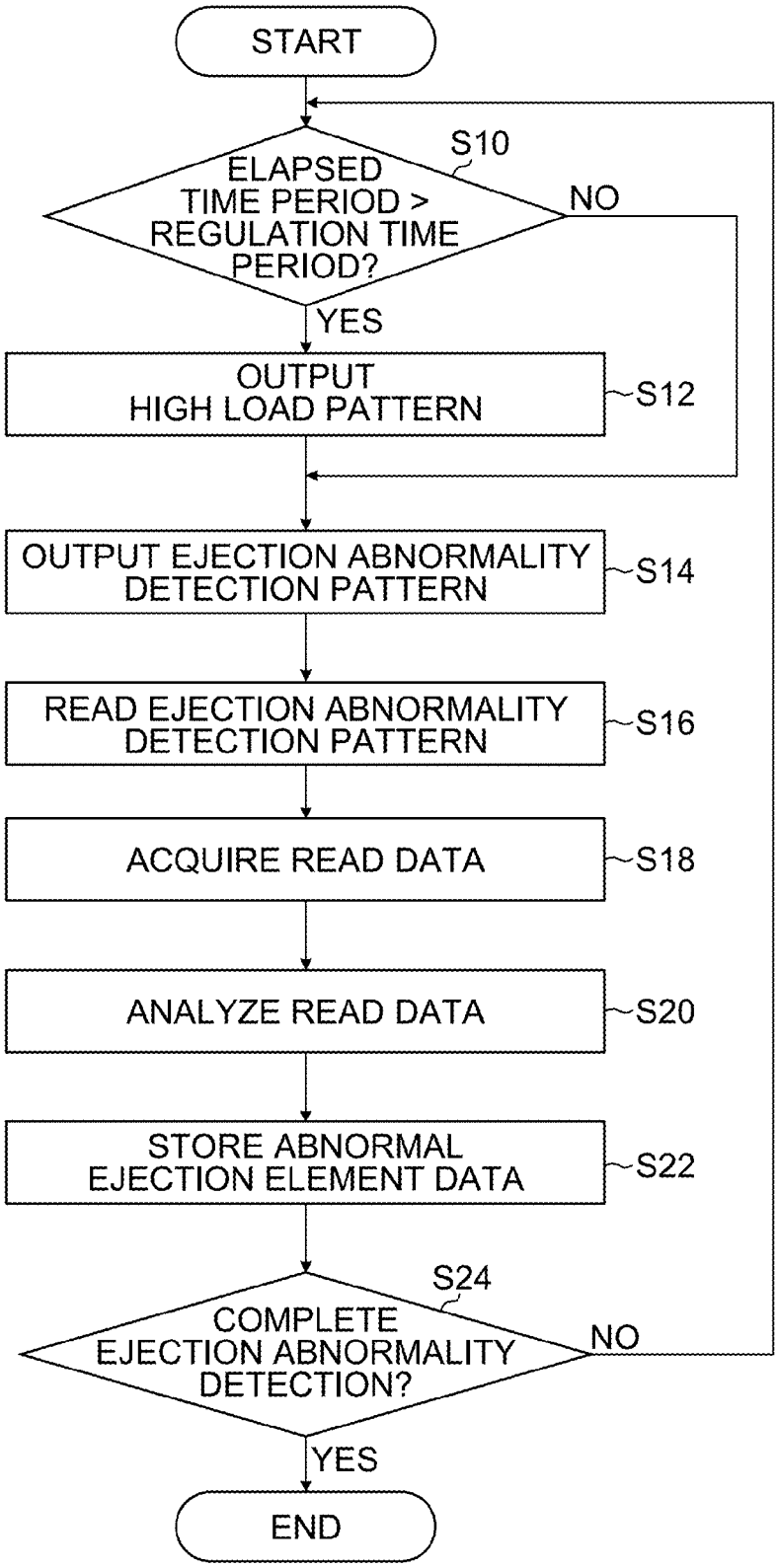
FIG. 2 is a flowchart showing a flow of the ejection abnormality detection method according to a first embodiment of the invention.

FIG. 2 is a flowchart showing a flow of the ejection abnormality detection method according to the first embodiment of the invention. In the ejection abnormality detection method described below, an ejection abnormality detection test chart with high load pattern is output, read data of the ejection abnormality detection pattern 3 shown in FIG. 1 in the ejection abnormality detection test chart with high load pattern is analyzed, and presence or absence of ejection abnormality is determined for each ejection element. An ejection element determined to have ejection abnormality occurrence is stored as an abnormal ejection element.

Hereinafter, a description is given, as an example, of the ejection abnormality detection method in an inkjet recording apparatus including a full line type inkjet head.

As shown in FIG. 2, once the ejection abnormality detection method starts, it is determined at an elapsed time period determination step S10 whether or not an elapsed time period from the previous outputting of the high load pattern 2 shown in FIG. 1 exceeds a predetermined regulation time period.

At the elapsed time period determination step S10 in FIG. 2, if the high load pattern 2 shown in FIG. 1 is output, an elapsed time period is measured from the time when the high load pattern 2 is output.

If determination at the elapsed time period determination step S10 in FIG. 2 is YES, that is, the elapsed time period from the last outputting of the high load pattern 2 shown in FIG. 1 exceeds the predetermined regulation time period, the high load pattern 2 shown in FIG. 1 is output at a high load pattern outputting step S12 in FIG. 2. Outputting of the high load pattern 2 is carried out with the inkjet head being operated under the high loaded condition, which is not used for a regular image forming processing, further higher than the high loaded condition in the regular image forming processing. The high load pattern is described later in detail.

The regulation time period is adequately defined depending on the inkjet head that is the object of ejection abnormality detection and the type of ink used. If the high load pattern 2 shown in FIG. 1 is output, the ejection state of the inkjet head varies as a time period elapses. The regulation time period may be examined and stored in advance for each inkjet head and for each ink such that the regulation time period stored in advance may be read out and used when the ejection abnormality detection is carried out.

The regulation time period can be regulated in accordance with the number of media to which ink ejection is carried out. In the case where the regulation time period is regulated in accordance with the number of media to which the ink ejection is carried out, at the elapsed time period determination step S10 in FIG. 2, the number of media to which the ink ejection is carried out is measured from the time when the high load pattern 2 is output.

A regulation time period setting step of setting the regulation time period may be also included such that the regulation time period can be externally set. As a regulation time period setting device which sets the regulation time period, a setting unit 28 in FIG. 3 may be used.

If the high load pattern 2 shown in FIG. 1 is output at the high load pattern outputting step S12 in FIG. 2, the process proceeds to an ejection abnormality detection pattern outputting step S14 in FIG. 2, and the ejection abnormality detection pattern 3 shown in FIG. 1 is output.

If determination at the elapsed time period determination step S10 in FIG. 2 is NO, that is, the elapsed time period from the last outputting of the high load pattern 2 shown in FIG. 1 is the predetermined regulation time period or less, the process proceeds to the ejection abnormality detection pattern outputting step S14 in FIG. 2.

In the successive ejection abnormality detection plural times, the processing for the first time invariably performs the elapsed time period determination step S10 and the high load pattern outputting step S12. In the processing for the second and subsequent times, the simulative high loaded condition owing to outputting the high load pattern in the processing up to the previous one is maintained in some cases, and, in such a case, the outputting of the high load pattern may be omitted.

At the ejection abnormality detection pattern outputting step S14, the ejection abnormality detection pattern 3 is output. The ejection abnormality detection pattern 3 is described later in detail.

If the ejection abnormality detection pattern 3 shown in FIG. 1 is output at the ejection abnormality detection pattern outputting step S14 in FIG. 2, the ejection abnormality detection pattern 3 shown in FIG. 1 is read out at an ejection abnormality detection pattern reading step S16 in FIG. 2. The high load pattern 2 may not be an object of reading, or high load pattern 2 may be read out together with the ejection abnormality detection pattern 3.

At the ejection abnormality detection pattern reading step S16 in FIG. 2, a scanner device including an image sensor is applied. In reading out the ejection abnormality detection pattern 3 shown in FIG. 1, an in-line sensor provided to the inkjet recording apparatus may be applied or an external scanner device may be applied.

If the read data of the ejection abnormality detection pattern 3 shown in FIG. 1 is generated at the ejection abnormality detection pattern reading step S16 in FIG. 2, the read data of the ejection abnormality detection pattern 3 shown in FIG. 1 is acquired at a read data acquiring step S18 in FIG. 2.

If the read data of the ejection abnormality detection pattern 3 shown in FIG. 1 is acquired at the read data acquiring step S18 in FIG. 2, the read data is analyzed at a read data analyzing step S20 in FIG. 2 to determine presence or absence of an abnormality for each of a plurality of ejection elements provided to the inkjet head.

At the read data analyzing step S20, the high load pattern 2 shown in FIG. 1 is not an object of analysis, and the ejection abnormality detection pattern 3 is an object of analysis.

As for the ejection element determined to be abnormal at the read data analyzing step S20, the determination of abnormality is stored at an ejection element data storing step S22. In a case where a type of abnormality, a cause of abnormality and the like are determined, the type of abnormality, the cause of abnormality and the like are stored as for the ejection element determined to be abnormal.

If the presence or absence of an abnormality is stored for each of the plurality of ejection elements provided to the inkjet head at the ejection element data storing step S22, it is determined whether or not the ejection abnormality detection is completed at an ejection abnormality detection completion determining step S24. If determination at the ejection abnormality detection completion determining step S24 is YES, that is, the ejection abnormality detection is determined to be completed, a completion process is performed.

On the other hand, if the determination at ejection abnormality detection completion determining step S24 is NO, that is, the ejection abnormality detection is determined to be continued, the process proceeds to the elapsed time period determination step S10, and the steps from the elapsed time period determination step S10 are repeatedly performed.

<Description of Apparatus Configuration>

Figure 3:
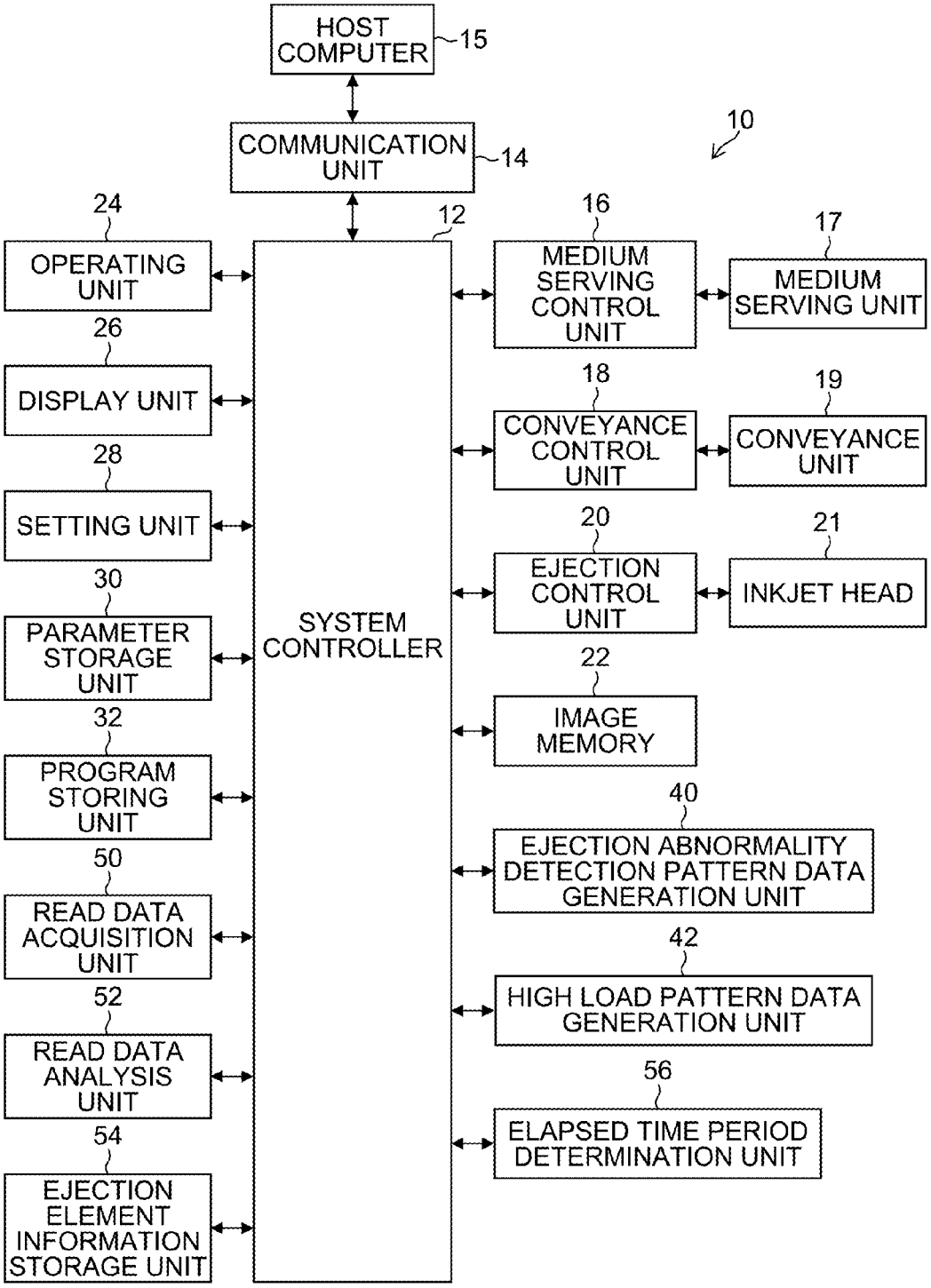
FIG. 3 is a block diagram of an inkjet recording apparatus to which the ejection abnormality detection method according to the first embodiment of the invention is applied.

FIG. 3 is a block diagram of an inkjet recording apparatus to which the ejection abnormality detection method according to the first embodiment of the invention is applied.

Individual units of an inkjet recording apparatus 10 shown in FIG. 3 are generally controlled by a system controller 12. The system controller 12 sends a command signal to a communication unit 14, a medium serving control unit 16, a conveyance control unit 18, an ejection control unit 20 and the like to control an operation of each unit. The system controller 12 may adopt a configuration including a central processing unit, a storage memory and device drivers corresponding to various functions.

The system controller 12 has a function as a memory controller to control reading out information from a storage unit such as an image memory 22, a parameter storage unit 30, and a program storing unit 32, and writing the information into the storage device.

The system controller 12 acquires an input signal sent from an operating unit 24 and a setting signal representing a setting which is input from a setting unit 28, and generates the command signal for a relevant configuration on the basis of content of the input signal or setting signal to send the command signal to the relevant configuration. Moreover, the system controller 12 stores setting information represented by the setting signal in a predefined storage unit.

To the operating unit 24, an operating member such as an operation button, a keyboard, a mouse may be applied.

The system controller 12 functions as a display driver to control display of information on a display unit 26. To the display unit 26, a display device may be applied. A touch panel type display device may be used so as to function as both the operating unit 24 and the display unit 26.

The communication unit 14 is an input interface to which input are various pieces of data such as ejection data sent from a host computer 15. A form of communication between the communication unit 14 and the host computer 15 may be wired communication or wireless communication. The communication unit 14 may be connected with the host computer 15 via a network.

The medium serving control unit 16 controls an operation of a medium serving unit 17 on the basis of the command signal sent from the system controller 12. A medium that is an object of image forming is served from the medium serving unit 17. Examples of the operation of the medium serving unit 17 include taking out a medium from a medium stock unit in which the media are stocked, adjusting an attitude of a medium, and so on.

The conveyance control unit 18 controls start of conveyance, stop of conveyance, speed of conveyance, and the like for a conveyance unit 19 conveying the medium served via the medium serving unit 17 on the basis of the command signal sent from the system controller 12.

The conveyance control unit 18 controls a conveyance pitch of the medium in a medium conveyance direction depending on an image formation resolution. Further, the conveyance control unit 18 controls the conveyance speed of the medium depending on the image formation resolution and an ejection frequency of an inkjet head 21. The image formation resolution is an aspect of the ejection resolution.

The ejection control unit 20 controls ink ejection carried out by the inkjet head 21. In a case where color image formation is carried out using a plurality of colors, the inkjet head 21 shown in FIG. 3 includes inkjet heads 21C, 21M, 21Y, and 21K for respective colors shown in FIG. 20.

The ejection control unit 20 is provided with an image processing unit not shown in the figure and a drive voltage generation unit not shown in the figure. The image processing unit generates dot data representing an arrangement of dots, that is, representing a size of dots or the number of dots per one pixel, from input image data sent from the host computer 15 via the communication unit 14.

Examples of the input image data sent from the host computer 15 include raster data which represents a density value of each pixel by means of digital values from 0 to 255. The image processing unit subjects the input image data to color separation processing, color conversion processing, correction processing, and half-tone processing to generate the dot data in which a size is defined for a position of the dot for each color.

An ejection timing and ejection volume for a pixel position are determined on the basis of the dot data generated by the image processing unit. The ejection volume herein is a liquid for forming one dot, and in a case where one dot is formed through plural times of ejection at a high frequency, the ejection volume in total obtained through plural times of ejection is set to the ejection volume. The ejection volume may be sometimes called an ejection amount.

To the ejection herein, the aspect may be adopted in which one dot is formed in one time or the aspect may be adopted in which one dot is formed in plural times. In addition, the dot is a constituent unit of the dot data after subjected to the half-tone processing, and in an image actually made through the image forming, a plurality of dots arranged in a high density are unified.

The drive voltage generation unit generates a drive voltage to be served to inkjet head 21 on the basis of the ejection timing and ejection volume for each dot position and serves the drive voltage to the inkjet head 21. Configuration examples of the drive voltage generation unit include a configuration provided with a drive waveform storage unit for storing a drive waveform stored therein, an amplification unit for amplifying a drive waveform, and a drive voltage output unit for outputting a drive voltage.

The input image data sent from the host computer 15 via the communication unit 14 is temporarily stored in the image memory 22. The input image data temporarily stored in the image memory 22 is subjected to the image processing by the image processing unit not shown in the figure.

The setting unit 28 performs various settings for the inkjet recording apparatus 10. Examples of the setting by the setting unit 28 include setting of the image formation resolution, or the setting of the regulation time period.

Various parameters used for the inkjet recording apparatus 10 are stored in the parameter storage unit 30. The various parameters stored in the parameter storage unit 30 are read out via the system controller 12 to be set to the respective units of the apparatus.

Programs used for the respective units of the inkjet recording apparatus 10 are stored in the program storing unit 32. The various programs stored in the program storing unit 32 are read out via the system controller 12 to be executed in the respective units of the apparatus.

Examples of the program stored in the program storing unit 32 include an ejection abnormality detection program which causes a computer to function as each of the units of the inkjet recording apparatus 10.

An ejection abnormality detection pattern data generation unit 40 generates, on the basis of the control by the system controller 12, ejection abnormality detection pattern data which is applied to ejection control in outputting the ejection abnormality detection pattern 3 shown in FIG. 1. A configuration may be also adopted in which an ejection abnormality detection pattern data storage unit is included for storing the generated ejection abnormality detection pattern data, and the ejection abnormality detection pattern data is read out from the ejection abnormality detection pattern data storage unit in generating the ejection abnormality detection pattern 3. The ejection abnormality detection pattern data generation unit 40 in FIG. 3 corresponds to the ejection abnormality detection pattern data generation device.

A high load pattern data generation unit 42 generates, on the basis of the control by the system controller 12, high load pattern data applied to the ejection control in outputting the high load pattern 2 shown in FIG. 1. A configuration may be also adopted in which a high load pattern data storage unit is included for storing the generated high load pattern data, and the high load pattern data is read out from the high load pattern data storage unit in outputting the high load pattern 2. The high load pattern data generation unit 42 in FIG. 3 corresponds to the high load pattern data generation device.

A read data acquisition unit 50 acquires, on the basis of the command signal from the system controller 12, the read data of the ejection abnormality detection pattern. Examples of the aspect of acquiring the read data include an aspect of acquiring an output signal from the in-line sensor, and an aspect of acquiring an output signal from the scanner device.

The read data acquisition unit 50 may acquire the read data from an external scanner device via the communication unit 14. The read data acquisition unit 50 corresponds to a read data acquisition device.

A read data analysis unit 52 analyzes, on the basis of the command signal from the system controller 12, the read data acquired by the read data acquisition unit 50 to determine the presence or absence of an abnormality for each ejection element. Information on the ejection element such as the presence or absence of an abnormality for each ejection element is stored in an ejection element information storage unit 54. The read data analysis unit 52 corresponds to a read data analysis device.

A determination criterion for the presence or absence of an ejection element abnormality depends on performance of the inkjet head, the image formation resolution, and the like. For example, an aspect may be adopted in which an acceptable range of dot position displacement or the an acceptable range of dot size is set, the dot position or dot size for each ejection element or for each dot size is measured, and those out of the acceptable range of dot position displacement or out of the acceptable range of dot size are determined to be abnormal.

The ejection control unit 20 uses the information on the presence or absence of an abnormality for each ejection element stored in the ejection element information storage unit 54 to subject the input image data to the correction processing. The ejection control unit 20 corresponds to an ejection control device.

An elapsed time period determination unit 56 measures an elapsed time period from when the high load pattern 2 shown in FIG. 1 is output to determine whether or not the elapsed time period from the outputting of the high load pattern 2 exceeds a predefined regulation time period. A signal representing a determination result from the elapsed time period determination unit 56 is transmitted to the system controller 12.

The system controller 12 sends the command signal to the ejection control unit 20 on the basis of the signal representing the determination result from the elapsed time period determination unit 56. The ejection control unit 20 outputs the high load pattern 2 shown in FIG. 1, and the ejection abnormality detection pattern 3 on the basis of the command signal.

The system controller 12, ejection control unit 20, ejection abnormality detection pattern data generation unit 40, high load pattern data generation unit 42, read data acquisition unit 50, read data analysis unit 52, ejection element information storage unit 54, and elapsed time period determination unit 56 shown in FIG. 3 function as an ejection abnormality detection control unit.

<Description of Pattern for Ejection Abnormality Detection>

Figure 4:
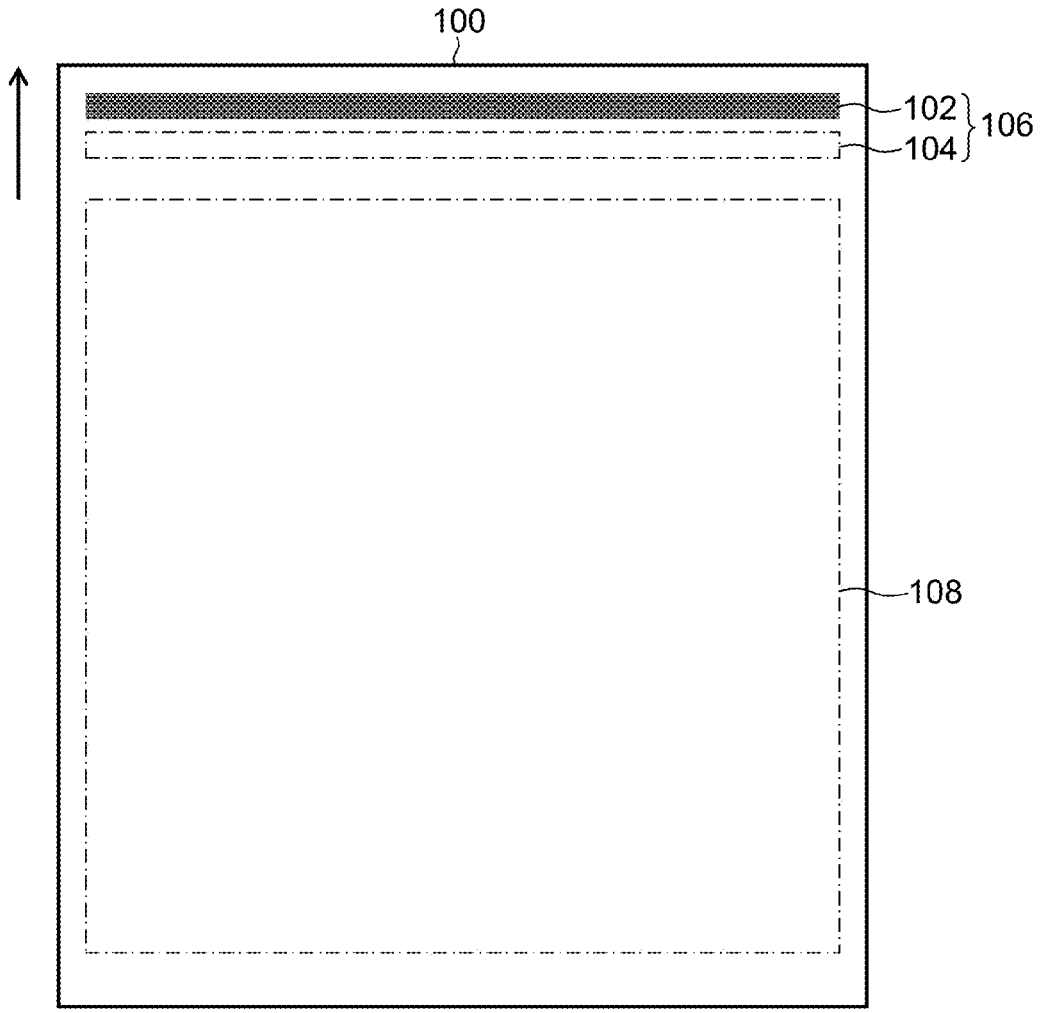
FIG. 4 is a schematic diagram showing an arrangement example of an ejection abnormality detection test pattern applied to the ejection abnormality detection method according to the first embodiment of the invention.

FIG. 4 is a schematic diagram showing an arrangement example of an ejection abnormality detection test pattern applied to the ejection abnormality detection method according to the first embodiment of the invention. An arrow line in FIG. 4 represents a conveyance direction of a medium 100. In the following description, the conveyance direction of the medium 100 may be also referred as a medium conveyance direction.

As shown in FIG. 4, a high load pattern output region 102 to which the high load pattern 2 shown in FIG. 1 is output is located on the most downstream side in the medium conveyance direction of the medium 100. An ejection abnormality detection pattern output region 104 to which the ejection abnormality detection pattern 3 shown in FIG. 1 is output is located on an upstream side in the medium conveyance direction of the high load pattern output region 102.

The high load pattern output region 102 and the ejection abnormality detection pattern output region 104 constitute an ejection abnormality detection test pattern output region 106. An image formation region 108 on which an image is formed on the basis of the input image data is located on the upstream side in the medium conveyance direction of the ejection abnormality detection test pattern output region 106.

FIG. 4 shows an aspect in which the ejection abnormality detection test pattern output region 106 is located to a margin region for the image formation region 108 in the medium 100 on the downstream side in the medium conveyance direction of the image formation region 108, and includes the high load pattern output region 102 and the ejection abnormality detection pattern output region 104. In such an aspect, the ejection abnormality detection of the inkjet head 21 shown in FIG. 2 can be carried out for each medium 100 subjected to the image formation.

Use of the location of the high load pattern output region 102 and ejection abnormality detection pattern output region 104 shown in FIG. 4 makes it possible to output the high load pattern 2 immediately before outputting the ejection abnormality detection pattern shown in FIG. 1.

<Description of High Load Pattern>

The high load pattern 2 shown in FIG. 1 is described in detail. For the high load pattern 2, used is a dot formed of ink having a volume which exceeds a volume of ink for forming a dot of the maximum size used in the regular image forming processing, for each of a plurality of ejection elements provided to the inkjet head 21 shown in FIG. 3.

In addition, in outputting the high load pattern 2 shown in FIG. 1, the ink is ejected from every ejection element capable of ink ejection. In other words, in outputting the high load pattern 2, a drive voltage meeting a condition for an ejection element in a normal ejection state to eject the above ink ejection volume is supplied to all ejection elements.

The dot of the maximum size used in the regular image forming processing depends on the image formation resolution, the performance of inkjet head, the type of ink and the like. The regular image forming processing refers to image formation carried out on the basis of the input image data, that is, image formation in which an image corresponding to the input image data is formed on the image formation region 108 shown in FIG. 4. For example, a case where an image as a commercial product such as a photograph is formed corresponds to the regular image forming processing.

In the regular image forming processing, the ink volume capable of being deposited to a medium may be limited depending on a type of medium or a type of ink in some cases. The inkjet head may be operated under the high loaded condition within a range of the ink volume limitation in some cases. The regular image forming processing is an aspect of regular liquid ejection.

It has been confirmed that in a case where an object of ejection abnormality detection is an inkjet head having the image formation resolution of 1200 dots per inch and an average ink ejection volume per one dot of 3.9 picoliters in outputting with the maximum density in the regular image forming processing, extraction of the unstable ejection element owing to outputting the high load pattern 2 can be made if the ink ejection volume for forming one dot in outputting the high load pattern 2 shown in FIG. 1 is set to 5.0 picoliters or more.

In the regular image forming processing, since dots of a plurality of sizes may be used in outputting with the maximum density in some cases, the ink volume for forming the dot of the maximum size used in the regular image forming processing is defined to be the average ejection volume of dots of a plurality of sizes.

It can be defined, from this ink ejection volume, that since the average ink ejection volume per one dot in outputting with the maximum density in the regular image forming processing corresponds to the ink volume for forming the dot of the maximum size used in the regular image forming processing, the ink volume for forming the dot of the high load pattern 2 is to be 1.25 times or more the ink volume for forming the dot of the maximum size used in the regular image forming processing.

The upper limit of the ink volume per one dot in outputting the high load pattern 2 is an ink volume for forming the dot of the maximum size capable of being formed by the inkjet head that is the object of ejection abnormality detection. An output condition of the high load pattern 2 can be defined in terms of a drive voltage in a piezoelectric type inkjet head which is provided with an ejection element including a piezo element.

The output condition of the high load pattern 2 described above is derived from a specific inkjet head, but can be applied to any inkjet head.

The inkjet head has ejection performance differentiated depending on conditions such as a configuration of the ejection element and a configuration of a flow channel, but needs to be supplied with larger electrical energy to generate larger mechanical energy in order to further increase the ejection volume.

If the inkjet head is supplied with the larger electrical energy and generates the larger mechanical energy, lager load is applied to the inkjet head. The piezoelectric type inkjet head which is provided with the ejection element including the piezo element may have the larger ejection volume by increasing the electrical energy supplied to the piezo element.

By increasing at a constant rate the electrical energy to be supplied with respect to the maximum electrical energy supplied in the regular image forming processing, an overload can be applied to the inkjet head at a constant rate, and thus, the output condition of the high load pattern 2 described above can be applied to any inkjet head.

Moreover, it is preferable, as the output condition of the high load pattern 2, to eject a liquid having a volume of 60% or more of the maximum ejection volume the inkjet head can eject. By fulfilling such a condition, a preferable simulative high loaded condition can be achieved in outputting the ejection abnormality detection pattern 3 shown in FIG. 1.

The simulative high loaded condition refers to an ejection state in a case where the ejection condition of the inkjet head is under the low loaded condition, that is, an ejection state equivalent to the high loaded condition.

Figure 5:
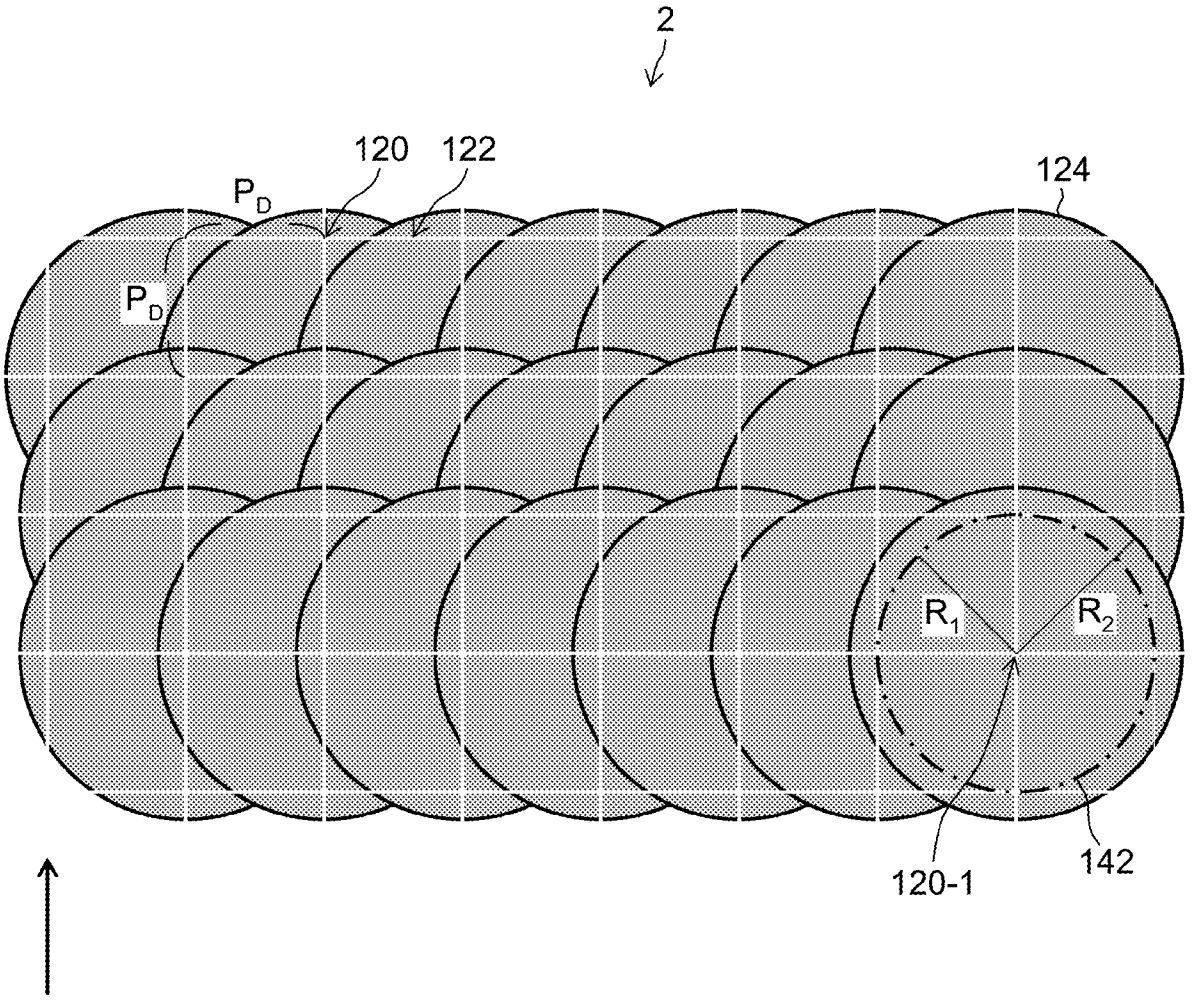
FIG. 5 is a schematic diagram showing an example of a dot arrangement of a high load pattern in an ejection abnormality detection test pattern with high load pattern.

FIG. 5 is a schematic diagram showing an example of a dot arrangement of the high load pattern in the ejection abnormality detection test pattern with high load pattern.

A lattice point 120 shown in FIG. 5 is a dot arranged position at the set image formation resolution. A length of one side of a lattice 122 shown in FIG. 5 is a dot arrangement distance PD at the set image formation resolution. For example, in the case of the image formation resolution of 1200 dots per inch, the dot arrangement distance PD is 21.2 micrometers. In the following description, description is given assuming that the image formation resolution is 1200 dots per inch both in the medium conveyance direction and in a direction perpendicular to the medium conveyance direction.

The term used herein, "perpendicular" or "vertical" inclusively means, of a case of crossing at an angle more than 90 degrees and a case of crossing at an angle less than 90 degrees, a state being substantially perpendicular or vertical exerting action and effect the same as in a case of crossing at an angle of 90 degrees.

Moreover, the term used herein "parallel" inclusively means a state of being substantially parallel exerting action and effect the same as of being parallel even where two directions crosses. Further, the term used herein "the same" inclusively means a state of being substantially the same capable of obtaining action and effect similar to "the same" even where a targeted configuration has a difference.

The ink ejected as liquid droplets from the inkjet head forms a dot having a radius proportional to the ejection volume. FIG. 5 schematically illustrates a relationship between the ejection volume in outputting the high load pattern 2 and the ink volume for forming the dot of the maximum size applied to the regular image forming processing, with the ejection volume being replaced with the radius of the dot.

In the high load pattern 2 shown in FIG. 5, dots 124 meeting the output condition of the high load pattern 2 described above are arranged at the respective lattice points 120. A dot 142 depicted by a dot-and-dash line in FIG. 5 is a dot arranged at a dot arranged position 120-1 and the dot of the maximum size applied to regular image forming processing.

Assuming that a radius $R_1$ is 1 of the dot 142 of the maximum size shown in FIG. 5 applied to the regular image forming processing, a radius $R_2$ is 1.25 of the dot 124 meeting the output condition of the high load pattern 2. The radius $R_1$ of the dot 142 the maximum size shown in FIG. 5 applied to the regular image forming processing has the dot arrangement distance $P_D$.

Figure 6A:
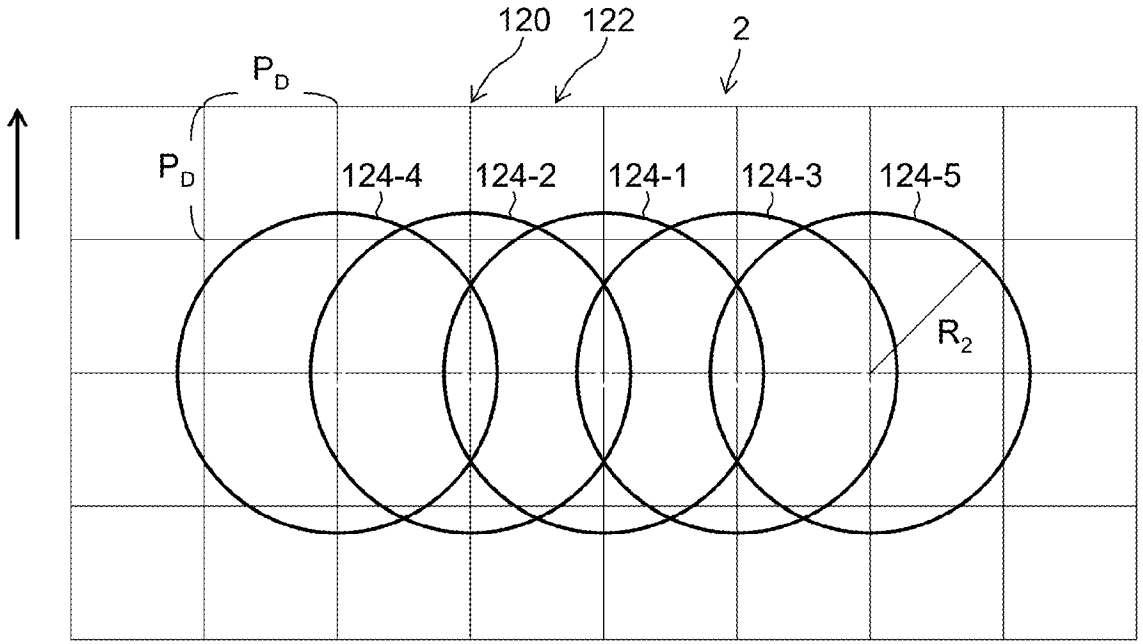
FIG. 6A is an enlarged view of the high load pattern shown in FIG. 5.
Figure 6B:
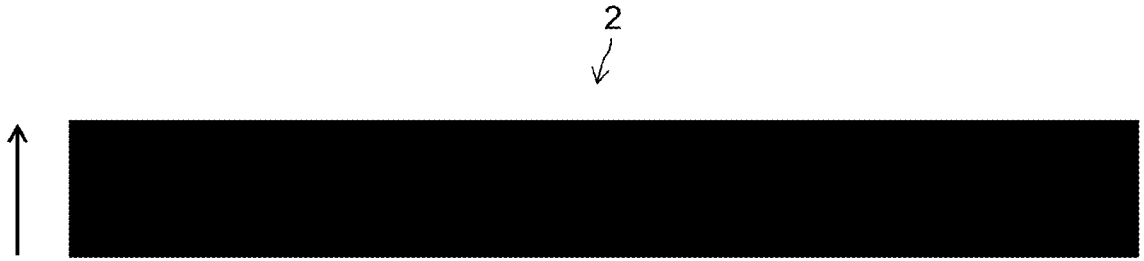
FIG. 6B is an overall view of the high load pattern shown in FIG. 5.

FIG. 6A is an enlarged view of the high load pattern shown in FIG. 5. FIG. 6B is an overall view of the high load pattern shown in FIG. 5. Arrow lines depicted in FIG. 6A and FIG. 6B represent the medium conveyance direction. In FIG. 6A and FIG. 6B, the same configuration as in FIG. 5 is designated by the same reference numeral and the description thereof is adequately omitted.

As shown in FIG. 6A, the high load pattern 2 has adjacent three or more dots overlapped each other in a direction perpendicular to the medium conveyance direction. In addition, not shown in FIG. 6A, but as shown FIG. 5, the high load pattern 2 has a dot arrangement in which three or more dots contact with each other in the direction perpendicular to the medium conveyance direction.

A dot 124-1 to a dot 124-5 shown in FIG. 6A each have the radius $R_2$ which is 1.25 times the dot arrangement distance PD. In the dot 124-1 to the dot 124-5 shown in FIG. 6A, adjacent three dots overlap each other.

Describing the dot 124-1 shown in FIG. 6A as an example, the dot 124-1 overlaps the dot 124-2 adjacent to the dot 124-1 and the dot 124-3 adjacent to the dot 124-1.

The dot 124-2 also overlaps the adjacent dot 124-3 which is on the opposite side of the dot 124-1.

Generally, in an inkjet type image formation, the ink volume capable of being deposited to a medium is limited depending on a type of medium and a type of ink. For example, in a case where inks of three colors are overlapped to represent a color, if the maximum density is represented, 100% of ink per one color, and 300% of ink for three colors are to be deposited, but in fact, 300% of ink cannot be deposited and the value is limited to less than 300% for three colors in total.

In the inkjet type image formation, if a high density pattern formation is carried out, the limitation on the ink volume is taken into consideration such that a size of a part of dots is adjusted or a part of dots is thinned out.

On the other hand, the high load pattern 2 shown in FIG. 5, FIG. 6A and FIG. 6B uses the ink having a volume exceeding the limitation on the ink ejection volume in the inkjet type regular image forming processing.

Then, from a view point of achieving the simulative high loaded condition in outputting the ejection abnormality detection pattern 3 shown in FIG. 1, the output condition of the high load pattern 2 is defined where the ink volume per one dot is 1.25 times the ink volume for forming the dot of the maximum size in the regular image forming processing.

Figure 7A:
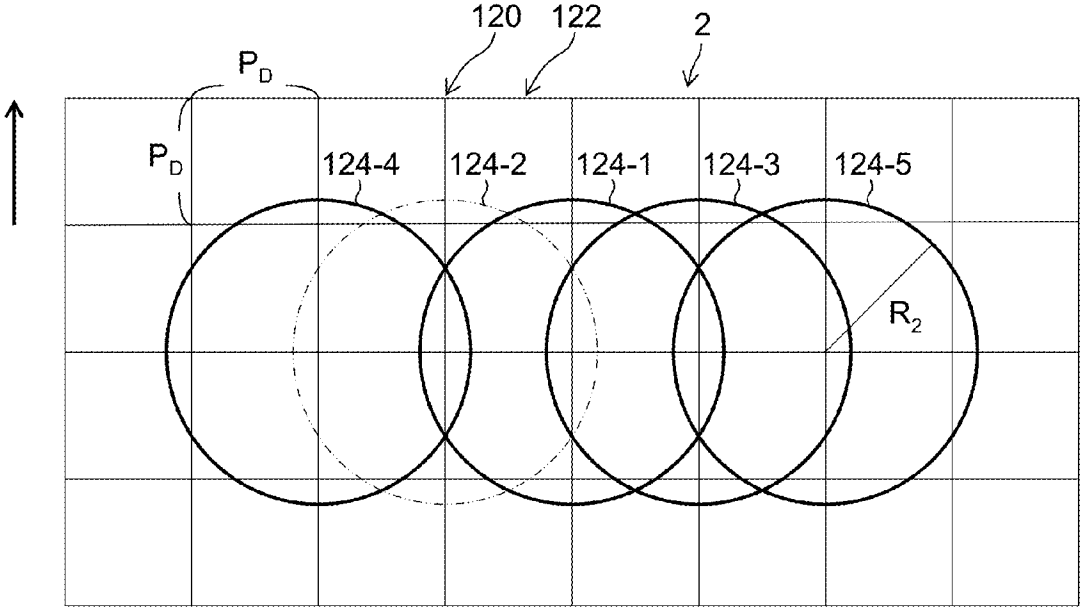
FIG. 7A is an enlarged view of a high load pattern in which a missing dot occurs.
Figure 7B:
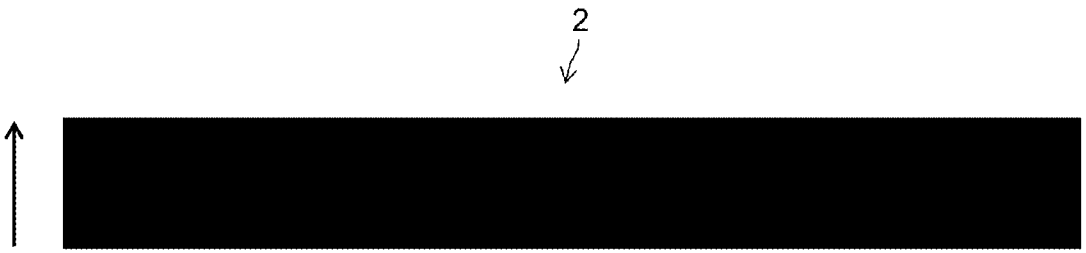
FIG. 7B is an overall view of a high load pattern in which a missing dot occurs.

FIG. 7A is an enlarged view of a high load pattern in which a missing dot occurs. FIG. 7B is an overall view of a high load pattern in which a missing dot occurs. In FIG. 7A and FIG. 7B, the same configuration as in FIG. 5, FIG. 6A and FIG. 6B is designated by the same reference numeral and the description thereof is adequately omitted.

FIG. 7A shows the high load pattern 2 in a case where the dot 124-2 depicted by a dashed-two dotted line is lost. If the dot 124-2 is lost, the density of the high load pattern 2 is decreased at an arranged position of the dot 124-2 in the direction perpendicular to the medium conveyance direction, but the dot 124-1 and the dot 124-4 are both next to the lost dot 124-2, and thus, a certain density is maintained. In other words, a possibly visible streak due to a missing dot is not generated as shown in FIG. 7B.

The high load pattern 2 applied to the ejection abnormality detection method according to the embodiment has such dot size and dot arrangement that a white streak is not generated even if one missing dot occurs. Moreover, it is difficult to detect the white streak due to one missing dot to find the abnormal ejection element by using the high load pattern 2 applied to the ejection abnormality detection method according to the embodiment, and therefore, the high load pattern 2 does not have a function to detect the white streak due to one missing dot to find the abnormal ejection element by analyzing the high load pattern 2.

Figure 8A:
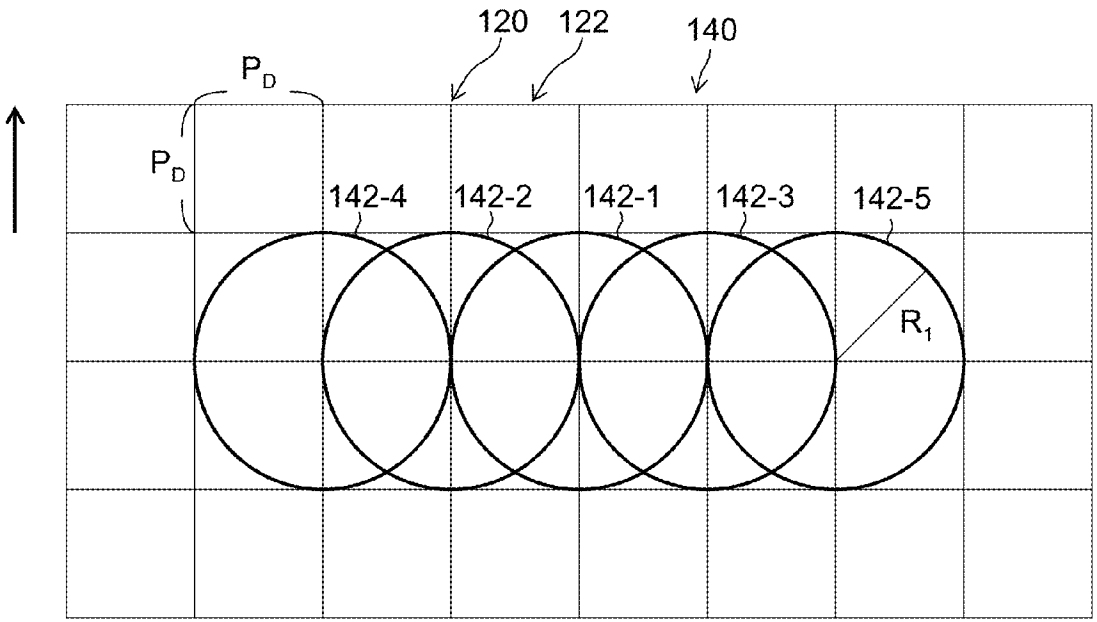
FIG. 8A is an enlarged view of a solid pattern formed by use of dots applied to regular image forming processing.
Figure 8B:
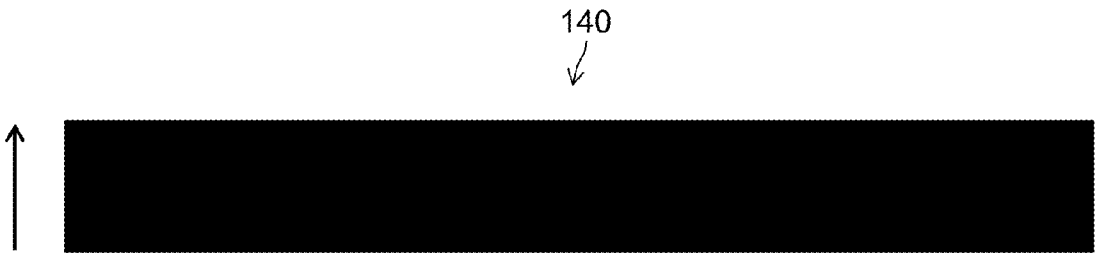
FIG. 8B is an overall view of the solid pattern shown in FIG. 8A.

FIG. 8A is an enlarged view of a solid pattern formed by use of the dots applied to the regular image forming processing. FIG. 8B is an overall view of the solid pattern shown in FIG. 8A. Arrow lines depicted in FIG. 8A and FIG. 8B represent the medium conveyance direction.

A solid pattern 140 shown in FIG. 8A and FIG. 8B has the image formation resolution of 1200 dots per inch and a diameter $R_1$ of a dot 142-1 to a dot 142-5 equal to the dot arrangement distance $P_D$.

Assuming that the image formation resolution is 1200 dots per inch, the dot arrangement distance $P_D$ is 21.2 micrometers. The ink volume of a dot having the radius $R_1$ of 21.2 micrometers is an average of 2.1 picoliters.

Figure 9A:
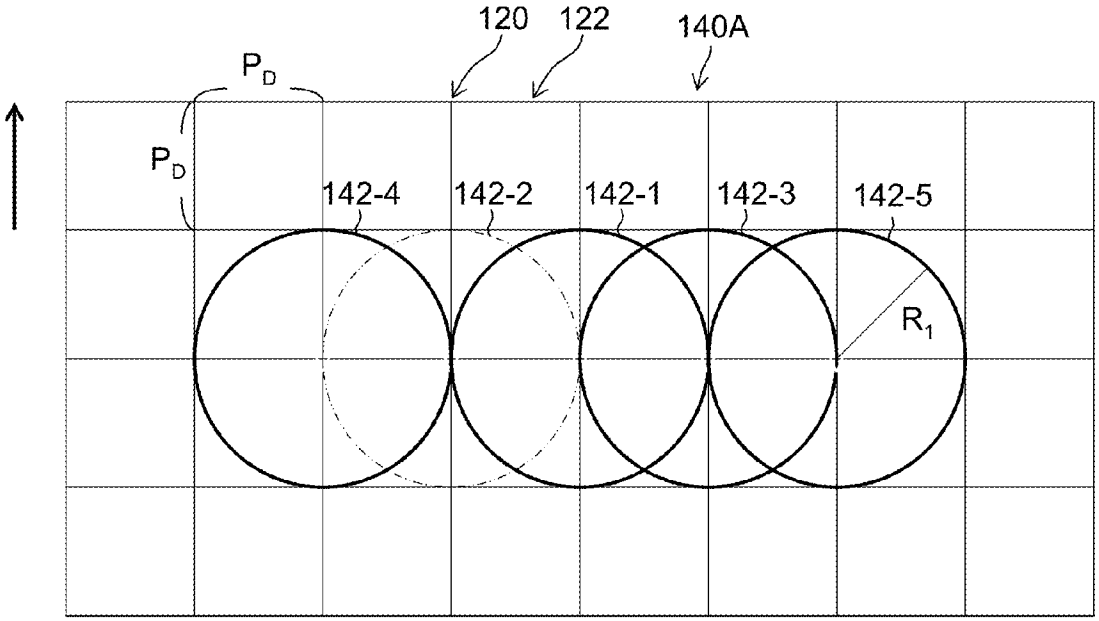
FIG. 9A is an enlarged view of a solid pattern formed by use of dots applied to the regular image forming processing in a case where a missing dot occurs.
Figure 9B:
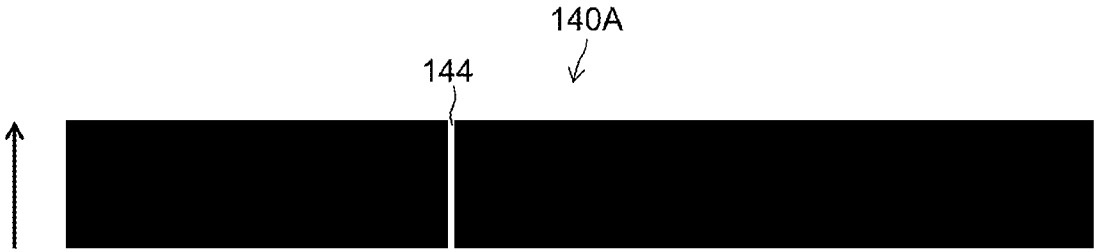
FIG. 9B is an overall view of the solid pattern shown in FIG. 9A.

FIG. 9A is an enlarged view of a solid pattern formed by use of dots applied to the regular image forming processing in a case where a missing dot occurs. FIG. 9B is an overall view of the solid pattern shown in FIG. 9A. Arrow lines depicted in FIG. 9A and FIG. 9B represent the medium conveyance direction.

The solid pattern 140A shown in FIG. 9A has lost the dot 142-2. Consequently, as shown in FIG. 9B, a white streak 144 is generated in the solid pattern 140A at an arranged position of the lost dot 142-2 along the medium conveyance direction.

As for the solid pattern described in Japanese Patent Application Laid-Open No. 2005-246650, the ejection element abnormality is detected by detecting a white streak due to a missing dot. In other words, the high load pattern 2 shown in FIG. 5, FIG. 6A or the like and the solid pattern described in Japanese Patent Application Laid-Open No. 2005-246650 are different from each other in the output condition and in the function.

<Description of Another Example of High Load Pattern>

Figure 10:
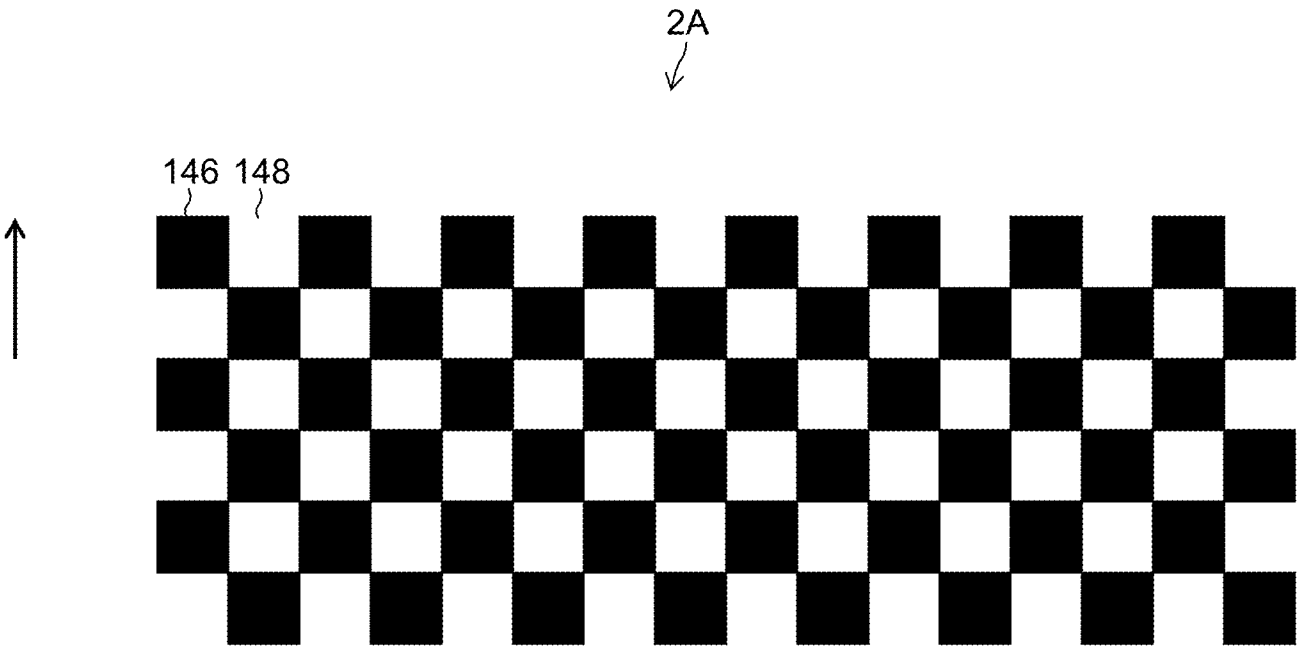
FIG. 10 is a schematic diagram of another example of the high load pattern.

FIG. 10 is a schematic diagram of another example of the high load pattern. An arrow line depicted in FIG. 10 represents the medium conveyance direction.

A high load pattern 2A shown in FIG. 10 is output with an on/off state of ejection of each ejection element being switched in a short period. The high load pattern 2A has on-regions 146 and off-regions 148.

An output condition of the on-region 146 is similar to that in the high load pattern 2 shown in FIG. 5 or the like, and therefore, the description thereof is omitted here. In the high load pattern 2A shown in FIG. 10, even in a case where not all ejection elements may carry out ejection at the same time, the action and effect similar to the high load pattern 2 shown in FIG. 5 or the like can be obtained.

Sizes of the on-region 146 and off-region 148 in the high load pattern 2A shown in FIG. 10 are merely examples, and may be changed depending on the performance of the inkjet head that is the object of ejection abnormality detection, a determination condition of the ejection abnormality or the like.

<Description of Ejection Abnormality Detection Pattern>

Figure 11:
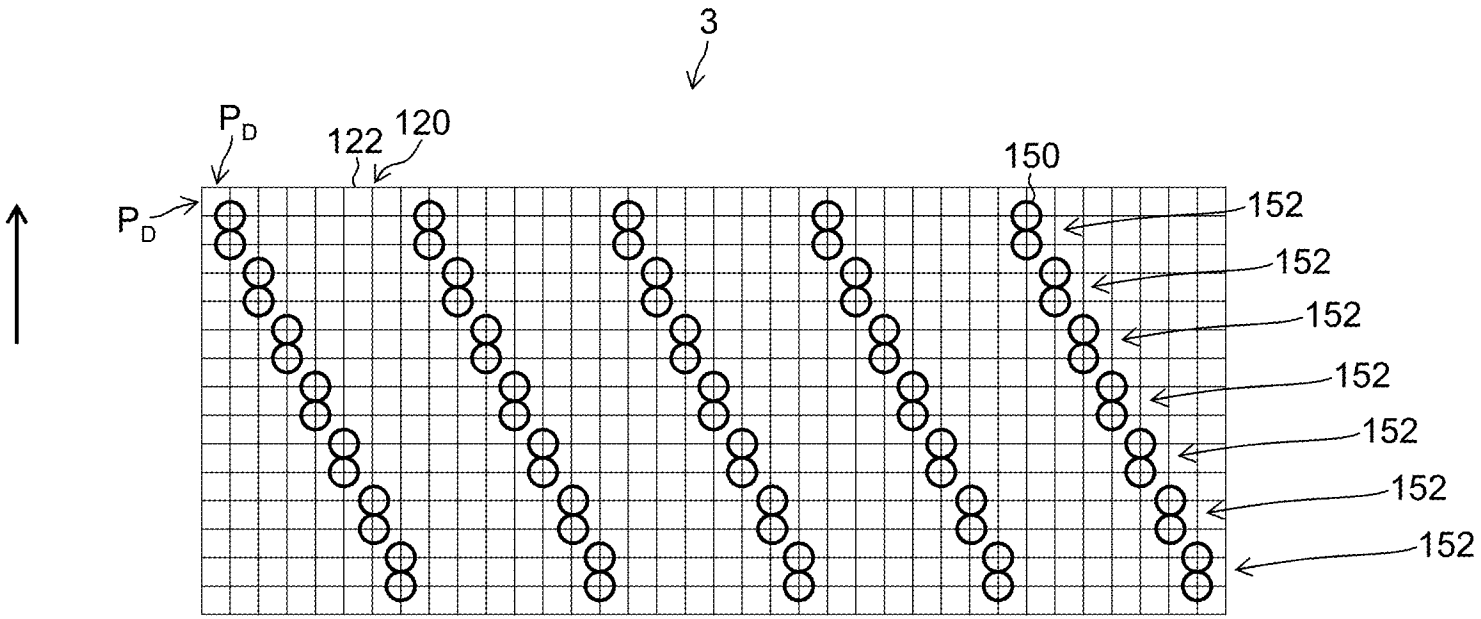
FIG. 11 is an illustration of an ejection abnormality detection pattern in an ejection abnormality detection test pattern with high load pattern.

FIG. 11 is an illustration of an ejection abnormality detection pattern in an ejection abnormality detection test pattern with high load pattern. In FIG. 11, the same configuration as in the previously described drawings is designated by the same reference numeral and the description thereof is adequately omitted. An arrow line depicted in FIG. 11 represents the medium conveyance direction.

An ejection abnormality detection pattern 3 shown in FIG. 11 is a so-called 1-on 6-off pattern. The ejection abnormality detection pattern 3 is configured to include seven tiers of patterns each of which has one tier of a pattern 152, and formed with the ejection element being switched, the pattern 152 being formed of a dot 150 arranged every six pixels in the direction perpendicular to the medium conveyance direction and a dot arranged on two pixels continuously in the medium conveyance direction. The dot arrangement distance in the direction perpendicular to the medium conveyance direction and the number of dots continuously arranged in the medium conveyance direction may be changed depending on a readout resolution and an area of a region where the ejection abnormality detection pattern 3 is formed.

Presence or absence of dot, presence or absence of position displacement at the dot arranged position, and a position displacement amount of the dot arranged position for each ejection element can be grasped by analyzing the read data of the ejection abnormality detection pattern 3 shown in FIG. 11.

In the ejection abnormality detection test pattern with high load pattern applied to the ejection abnormality detection according to the embodiment, the ejection abnormality detection pattern 3 shown in FIG. 11 is an object of reading. On the other hand, the high load pattern 2 shown in FIG. 5 or the like is not an object of reading or is not an object of analysis.

The ejection abnormality detection pattern applicable to ejection abnormality detection according to the embodiment is not limited to the ejection abnormality detection pattern 3 shown in FIG. 11. Those may be sufficient that can grasp from the read data the presence or absence of a dot arrangement, the position displacement of the dot arranged position and the like for each ejection element.

<Configuration Example of Ejection Abnormality Detection Test Pattern with High Load Pattern in Case of Plurality of Inkjet Heads being Provided>

Figure 12:
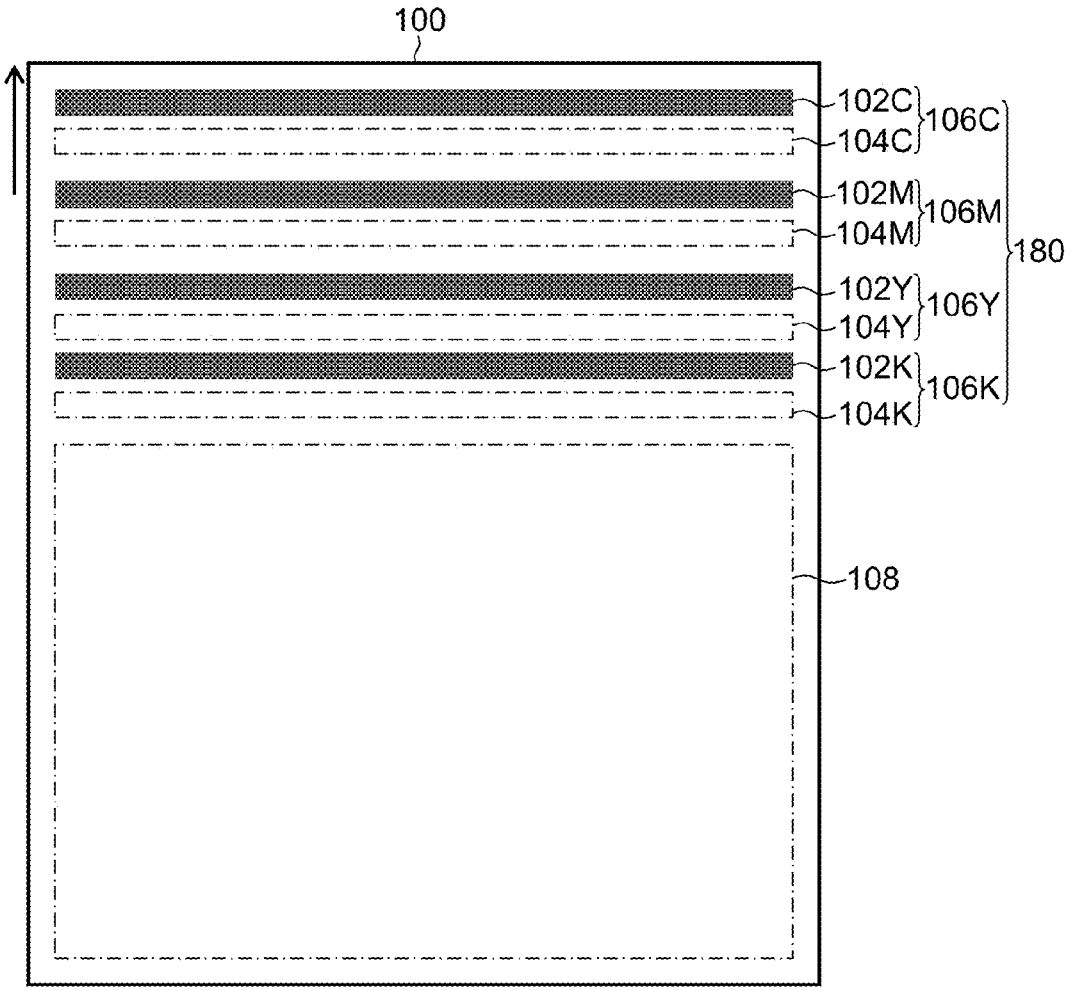
FIG. 12 is a schematic diagram showing an arrangement example of an ejection abnormality detection test pattern with high load pattern in a case where a plurality of inkjet heads are provided.

FIG. 12 is a schematic diagram showing an arrangement example of an ejection abnormality detection test pattern with high load pattern in a case where a plurality of inkjet heads are provided. An arrow line depicted in FIG. 12 represents the medium conveyance direction.

FIG. 12 shows an arrangement region 180 for ejection abnormality detection test pattern with high load pattern which is applied to an inkjet recording apparatus including a cyan ink head for ejecting a cyan ink, a magenta ink head for ejecting a magenta ink, a yellow ink head for ejecting a yellow ink, and a black ink head for ejecting a black ink.

Figure 20:
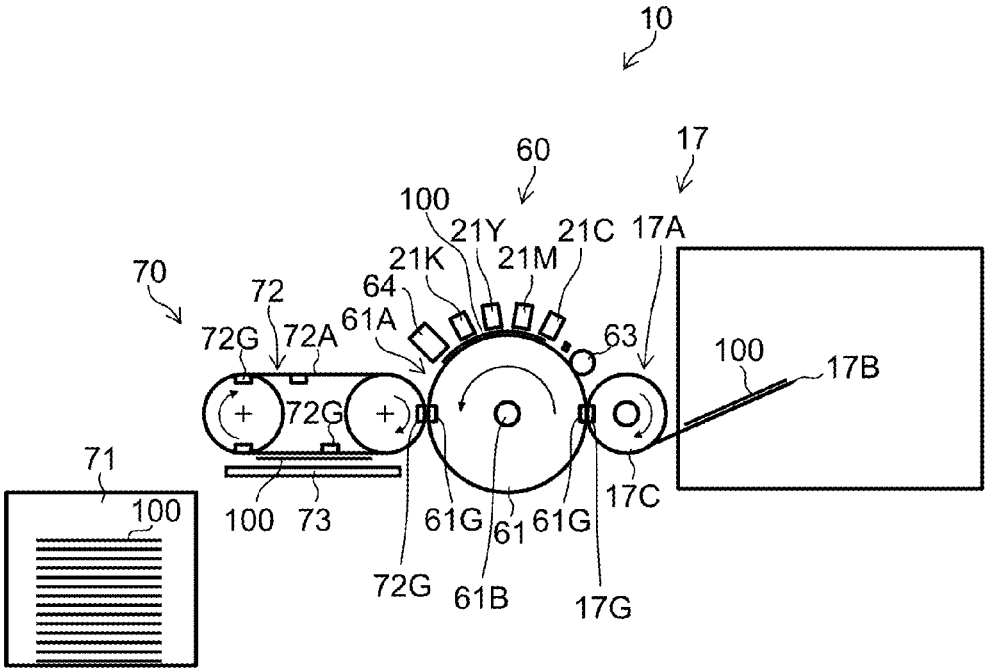
FIG. 20 is an overall configuration view of an inkjet recording apparatus in accordance with an apparatus configuration example.

The cyan head, the magenta head, the yellow head, and the black head are shown in FIG. 20 and designated by reference numerals 21C, 21M, 21Y, and 21K. In addition, the inkjet recording apparatus including the cyan head, the magenta head, the yellow head, and the black head is shown in FIG. 20 and designated by reference numeral 10.

In the arrangement region 180 for ejection abnormality detection test pattern with high load pattern shown in FIG. 12, located are a cyan ejection abnormality detection test pattern output region 106C to which an ejection abnormality detection test pattern for the cyan head is output, a magenta ejection abnormality detection test pattern output region 106M to which an ejection abnormality detection test pattern for the magenta head is output, a yellow ejection abnormality detection test pattern output region 106Y to which an ejection abnormality detection test pattern for the yellow head is output, and a black ejection abnormality detection test pattern output region 106K to which an ejection abnormality detection test pattern for the black head is output, in this order from the downstream side in the medium conveyance direction.

In the cyan ejection abnormality detection test pattern output region 106C, located are a cyan high load pattern output region 102C to which a cyan high load pattern is output, and a cyan ejection abnormality detection pattern output region 104C where a cyan ejection abnormality detection pattern is allocated, in this order from the downstream side in the medium conveyance direction.

In the magenta ejection abnormality detection test pattern output region 106M, located are a magenta high load pattern output region 102M to which a magenta high load pattern is output, and a magenta ejection abnormality detection pattern output region 104M where a magenta ejection abnormality detection pattern is allocated, in this order from the downstream side in the medium conveyance direction.

In the yellow ejection abnormality detection test pattern output region 106Y, located are a yellow high load pattern output region 102Y to which a yellow high load pattern is output, and a yellow ejection abnormality detection pattern output region 104Y where a yellow ejection abnormality detection pattern is allocated, in this order from the downstream side in the medium conveyance direction.

In the black ejection abnormality detection test pattern output region 106K, located are a black high load pattern output region 102K to which a black high load pattern is output, and a black ejection abnormality detection pattern output region 104K where a black ejection abnormality detection pattern is allocated, in this order from the downstream side in the medium conveyance direction.

Use of the ejection abnormality detection test pattern to which applied is the arrangement region 180 for ejection abnormality detection test pattern with high load pattern shown in FIG. 12 makes it possible to bring the ejection control of a plurality of inkjet heads and conveyance control of the medium 100 into a common control in outputting the ejection abnormality detection test pattern.

Further, the ejection abnormality detection test patterns of a plurality of inkjet heads can be read out in a series of processing steps.

Figure 13:
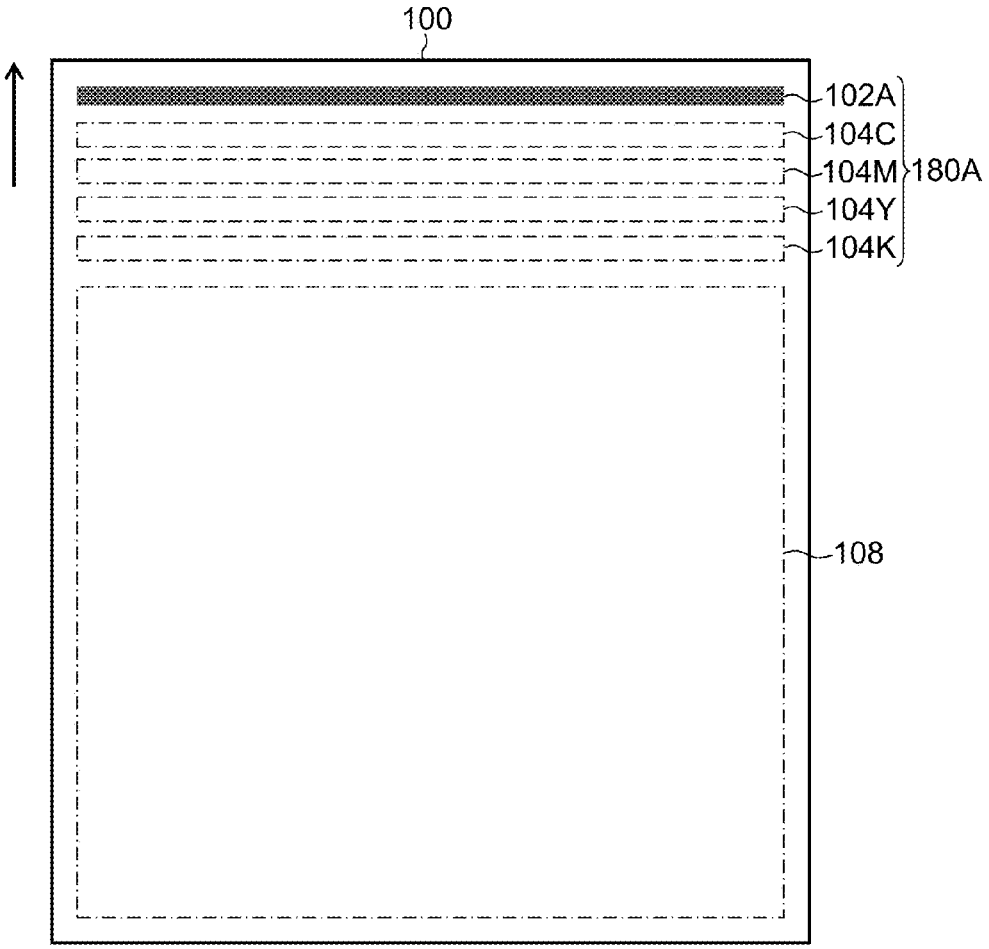
FIG. 13 is a schematic diagram showing another arrangement example of the ejection abnormality detection test pattern with high load pattern in a case where a plurality of inkjet heads are provided.

FIG. 13 is a schematic diagram showing another arrangement example of the ejection abnormality detection test pattern with high load pattern in a case where a plurality of inkjet heads are provided. In FIG. 13, the same configuration as in FIG. 12 is designated by the same reference numeral and the description thereof is adequately omitted.

In an ejection abnormality detection test pattern with high load pattern to be output to an arrangement region 180A for ejection abnormality detection test pattern shown in FIG. 13, the high load pattern output region is made to be a region common to the cyan head, the magenta head, the yellow head, and the black head, and the cyan ink, the magenta ink, the yellow ink, and the black ink are deposited to overlap each other.

In the arrangement region 180A for ejection abnormality detection test pattern shown in FIG. 13, located are a high load pattern output region 102A which is common to the cyan head, the magenta head, the yellow head, and the black head, the cyan ejection abnormality detection pattern output region 104C where the cyan ejection abnormality detection pattern is allocated, the magenta ejection abnormality detection pattern output region 104M where the magenta ejection abnormality detection pattern is allocated, the yellow ejection abnormality detection pattern output region 104Y where the yellow ejection abnormality detection pattern is allocated, and the black ejection abnormality detection pattern output region 104K where the black ejection abnormality detection pattern is allocated, in this order from the downstream side in the medium conveyance direction.

Since the high load pattern itself is not an object of reading, and thus, is not required for an image quality, a function of the high load pattern can be fulfilled even in a state where a plurality of colors overlap.

Use of the ejection abnormality detection test pattern with high load pattern to be output to the arrangement region 180A for ejection abnormality detection test pattern shown in FIG. 13 makes it possible to reduce the output region in the medium 100 for the ejection abnormality detection test pattern as compared with a case of using the ejection abnormality detection test pattern with high load pattern to be output to the arrangement region 180 for ejection abnormality detection test pattern shown in FIG. 12.

Action and Effect According to First Embodiment

According to the ejection abnormality detection method and liquid ejection device configured as described above, in the ejection abnormality detection of the inkjet head, the high load pattern is output, the ejection abnormality detection pattern is output within a specific period of time from outputting the high load pattern, and the presence or absence of an ejection element abnormality is determined on the basis of the read data of the ejection abnormality detection pattern.

Outputting of the ejection abnormality detection pattern within a specific period of time from outputting the high load pattern makes it possible to bring the ejection state of the inkjet head into a simulative high loaded condition in outputting the ejection abnormality detection pattern, and to extract an unstable ejection element as an abnormal ejection element in which an abnormality does not occur under the low loaded condition but occurs under the high loaded condition.

Second Embodiment

Description of Flowchart

Figure 14:
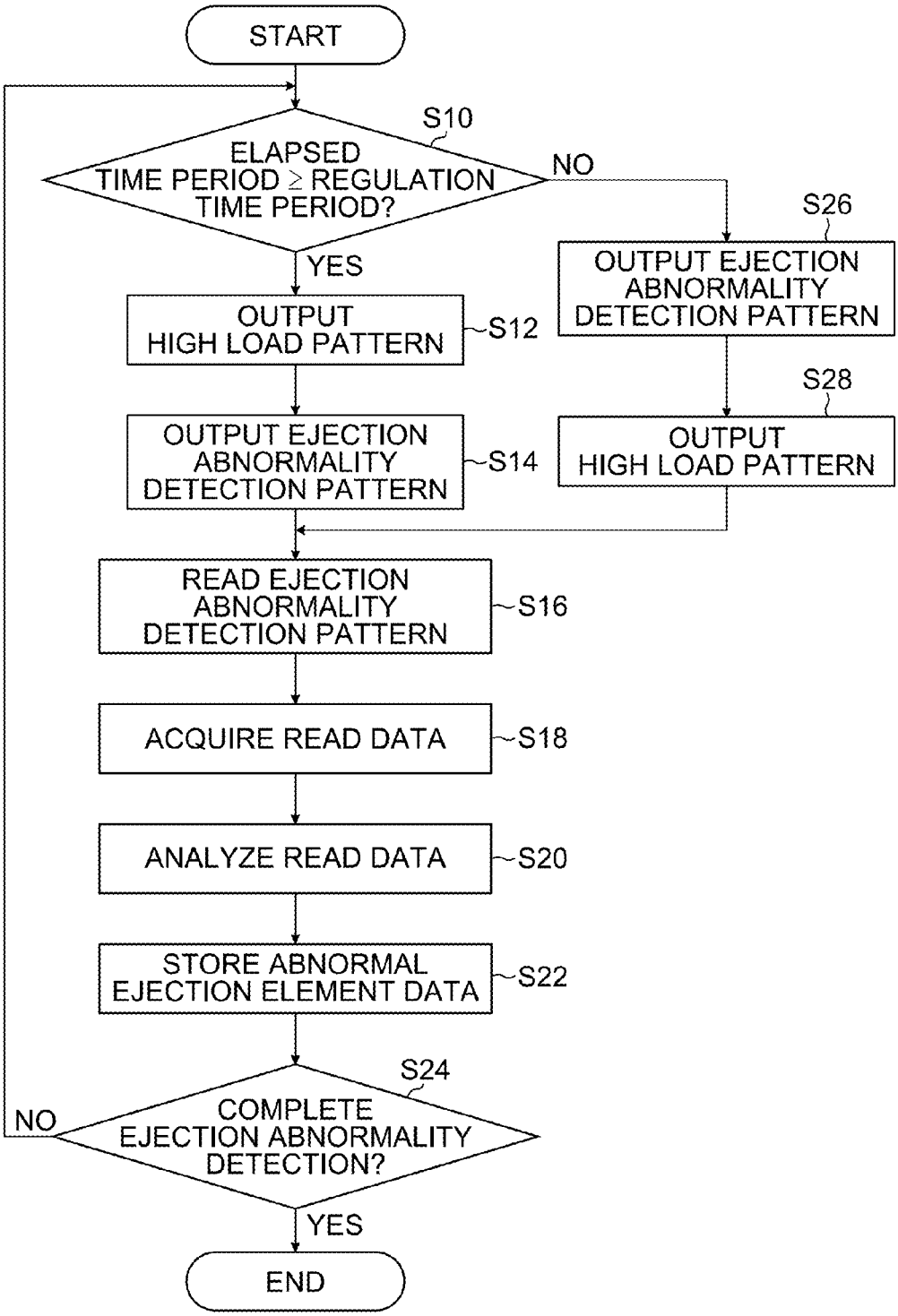
FIG. 14 is a flowchart showing a flow of an ejection abnormality detection method according to a second embodiment of the invention.

FIG. 14 is a flowchart showing a flow of an ejection abnormality detection method according to a second embodiment of the invention. In FIG. 14, the same step as in FIG. 2 is designated by the same reference numeral and the description thereof is adequately omitted.

In an ejection abnormality detection according to the second embodiment described below, in a case where the same ejection abnormality detection pattern is continuously output to a plurality of sheets of medium, the high load pattern is output after outputting the ejection abnormality detection pattern such that the ejection state of the inkjet head is brought into the simulatively high loaded condition in outputting the ejection abnormality detection pattern for the second and subsequent times.

In other words, if the determination at the elapsed time period determination step S10 is NO, that is, the elapsed time period from the outputting of the high load pattern 2 shown in FIG. 1 is the regulation time period or less, an ejection abnormality detection pattern outputting step S26 is performed to output the ejection abnormality detection pattern 3 shown in FIG. 1.

If the ejection abnormality detection pattern 3 shown in FIG. 1 is output at the ejection abnormality detection pattern outputting step S26 in FIG. 14, the high load pattern 2 shown in FIG. 1 is output at a high load pattern outputting step S28 shown in FIG. 14.

<Description of Pattern for Ejection Abnormality Detection>

Figure 15:
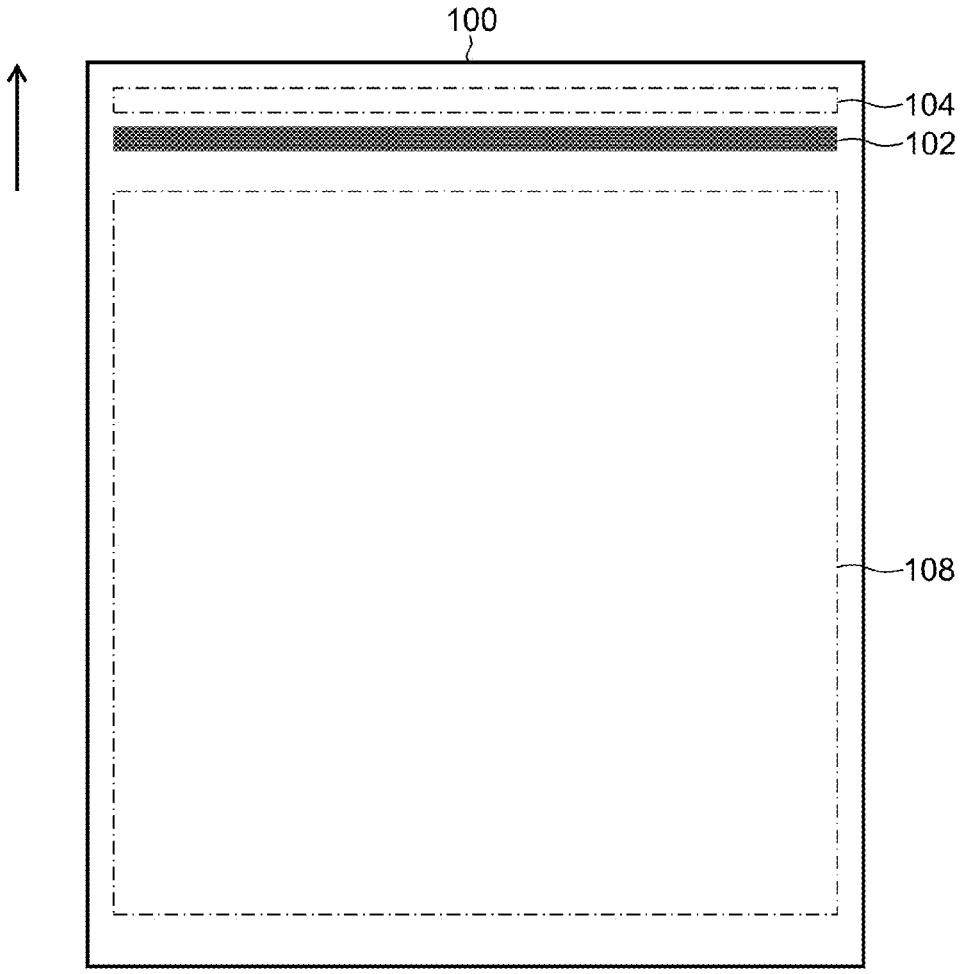
FIG. 15 is a schematic diagram showing an arrangement example of an ejection abnormality detection test pattern with high load pattern applied to the ejection abnormality detection method according to the second embodiment of the invention.

FIG. 15 is a schematic diagram showing an arrangement example of an ejection abnormality detection test pattern with high load pattern applied to the ejection abnormality detection method according to the second embodiment of the invention. The high load pattern output at the high load pattern outputting step S28 in FIG. 14 is output to the high load pattern output region 102 which is located, as shown in FIG. 15, on the upstream side of the ejection abnormality detection pattern output region 104 in the medium conveyance direction and on the downstream side of the image formation region 108, that is, located between the ejection abnormality detection pattern output region 104 and the image formation region 108.

Figure 16:
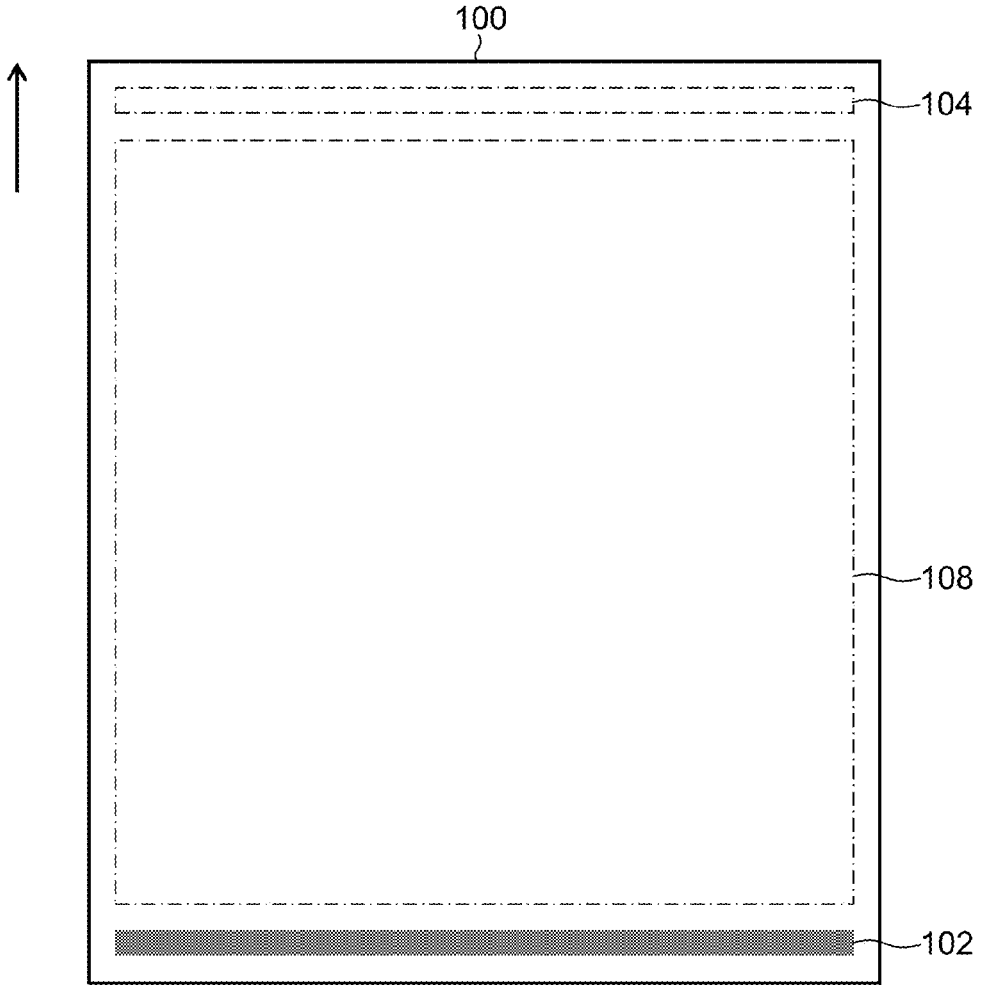
FIG. 16 is a schematic diagram showing another arrangement example of the ejection abnormality detection test pattern with high load pattern applied to the ejection abnormality detection method according to the second embodiment of the invention.

FIG. 16 is a schematic diagram showing another arrangement example of the ejection abnormality detection test pattern with high load pattern applied to the ejection abnormality detection method according to the second embodiment of the invention. The high load pattern output at the high load pattern outputting step S12 in FIG. 14 is output to the high load pattern output region 102 which is located, as shown in FIG. 16, on the upstream side of the image formation region 108 in the medium conveyance direction.

Use of the location of the high load pattern output region 102 and ejection abnormality detection pattern output region 104 shown in FIG. 15 and FIG. 16 makes it possible to output the ejection abnormality detection pattern 3 to a medium previous to a medium to which the high load pattern 2 shown in FIG. 1 is to be output, and to output the high load pattern 2 immediately before outputting the ejection abnormality detection pattern 3.

<Configuration Example of Ejection Abnormality Detection Test Pattern with High Load Pattern in Case of Plurality of Inkjet Heads being Provided>

Figure 17:
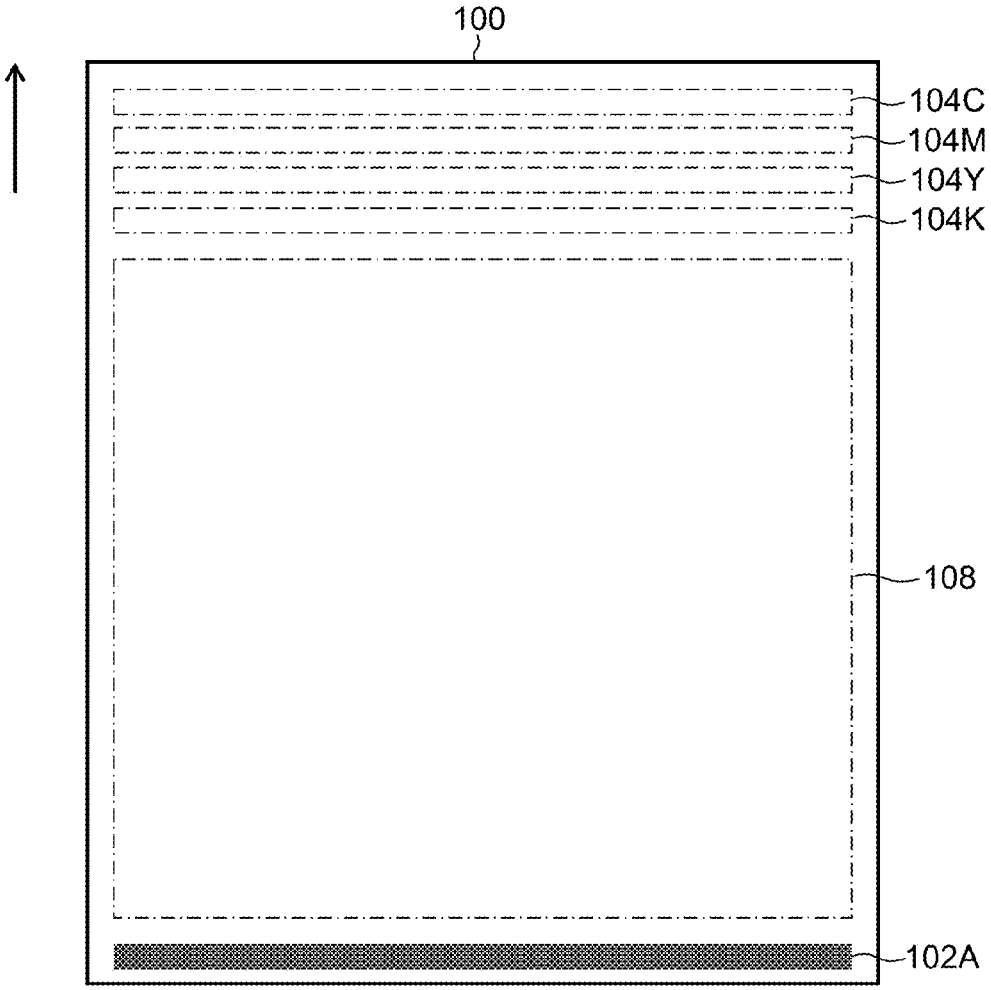
FIG. 17 is a schematic diagram showing an arrangement example of an ejection abnormality detection test pattern with high load pattern applied to an inkjet recording apparatus which includes a plurality of inkjet heads applied to the ejection abnormality detection method according to the second embodiment of the invention.

FIG. 17 is a schematic diagram showing an arrangement example of an ejection abnormality detection test pattern with high load pattern in a case of a plurality of inkjet heads being provided applied to the ejection abnormality detection method according to the second embodiment of the invention.

As shown in FIG. 17, located are the cyan ejection abnormality detection pattern output region 104C, the magenta ejection abnormality detection pattern output region 104M, the yellow ejection abnormality detection pattern output region 104Y, and the black ejection abnormality detection pattern output region 104K, in this order from the downstream side in the medium conveyance direction.

On the upstream side of the black ejection abnormality detection pattern output region 104K in the medium conveyance direction, located is the image formation region 108. On the upstream side of the image formation region 108 in the medium conveyance direction, located is the high load pattern output region 102A which is common to the cyan head, the magenta head, the yellow head, and the black head.

The high load pattern 2 shown in FIG. 1 output at the high load pattern outputting step S12 in FIG. 14 is output to the high load pattern output region 102A shown in FIG. 17. Moreover, the ejection abnormality detection pattern 3 shown in FIG. 1 output at ejection abnormality detection pattern outputting step S14 in FIG. 14 is output to the cyan ejection abnormality detection pattern output region 104C, the magenta ejection abnormality detection pattern output region 104M, the yellow ejection abnormality detection pattern output region 104Y, and the black ejection abnormality detection pattern output region 104K shown in FIG. 17.

In the ejection abnormality detection method according to the second embodiment, the high load pattern 2 and ejection abnormality detection pattern 3 shown in FIG. 1 are output in an appropriate combination of the high load pattern output regions 102 and 102A, the ejection abnormality detection pattern output region 104, the cyan ejection abnormality detection pattern output region 104C, the magenta ejection abnormality detection pattern output region 104M, the yellow ejection abnormality detection pattern output region 104Y, and the black ejection abnormality detection pattern output region 104K which are shown in FIG. 15, FIG. 16, and FIG. 17.

Action and Effect According to Second Embodiment

According to the ejection abnormality detection method and liquid ejection device configured as described above, in a case where the ejection abnormality detection pattern is successively output, it is possible to bring the ejection state of the inkjet head into a simulative high loaded condition in outputting the ejection abnormality detection pattern 3 for the second and subsequent times, and to extract an unstable ejection element as an abnormal ejection element in which an abnormality does not occur under the low loaded condition but occurs under the high loaded condition, similarly to the first embodiment.

In addition, the high load pattern output region to which the high load pattern is output from a plurality of inkjet heads is made to be common so as to be able to expect reduction of a region of a medium to which the high load pattern 2 is output.

Third Embodiment

Figure 18:
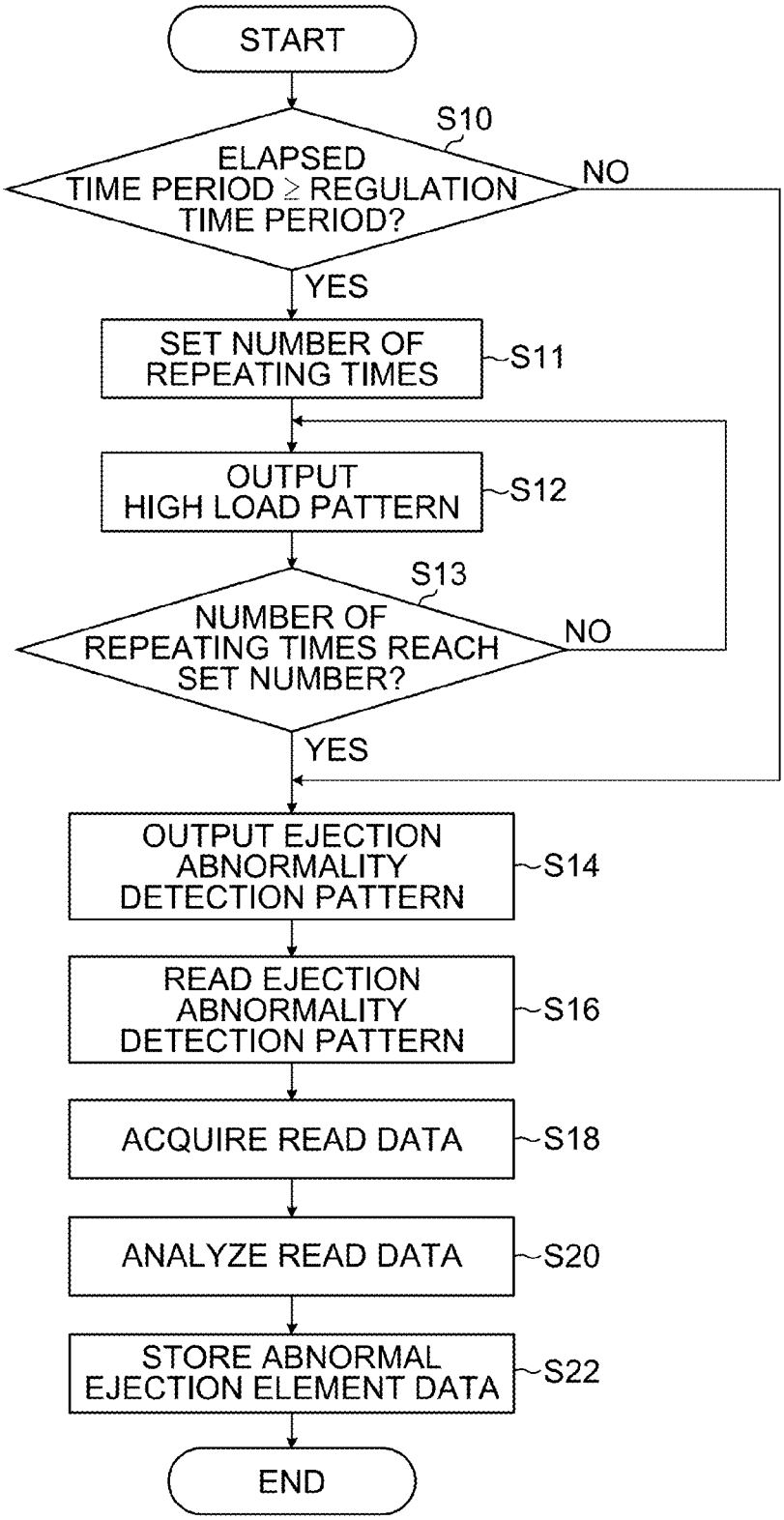
FIG. 18 is a flowchart showing a flow of an ejection abnormality detection method according to a third embodiment of the invention.

FIG. 18 is a flowchart showing a flow of an ejection abnormality detection method according to a third embodiment of the invention. In FIG. 18, the same step as in FIG. 2 and FIG. 14 is designated by the same reference numeral and the description thereof is adequately omitted.

In the ejection abnormality detection method according to the embodiment, outputting of the high load pattern 2 shown in FIG. 1 is performed successively plural times.

In the flowchart shown in FIG. 18, if the elapsed time period determination step S10 is performed, a repeating times number setting step S11 is performed. At the repeating times number setting step S11, the number of repeating times is set for the high load pattern 2 shown in FIG. 1.

Every time when the high load pattern outputting step S12 in FIG. 18 is performed, a repeating times number determining step S13 is performed. At the repeating times number determining step S13, it is determined whether or not the number of times performing the high load pattern 2 shown in FIG. 1 reaches the number of repeating times set at the repeating times number setting step S11 in FIG. 18.

If determination at the repeating times number determining step S13 in FIG. 18 is NO, that is, the number of times performing the high load pattern 2 shown in FIG. 1 is determined to not reach the number of repeating times set at the repeating times number setting step S11 in FIG. 18, the high load pattern outputting step S12 in FIG. 18 is performed.

If determination at the repeating times number determining step S13 in FIG. 18 is YES, that is, the number of times performing the high load pattern 2 shown in FIG. 1 is determined to reach the number of repeating times set at the repeating times number setting step S11 in FIG. 18, the ejection abnormality detection pattern outputting step S14 is performed.

Subsequently, the ejection abnormality detection pattern reading step S16, the read data acquiring step S18, the read data analyzing step S20, and the ejection element data storing step S22 are performed.

Action and Effect According to Third Embodiment

According to the ejection abnormality detection method configured as described above, outputting of the high load pattern is successively performed plural times before outputting the ejection abnormality detection pattern, further reliably extracting the unstable ejection element.

Modification Example of Third Embodiment

Figure 19:
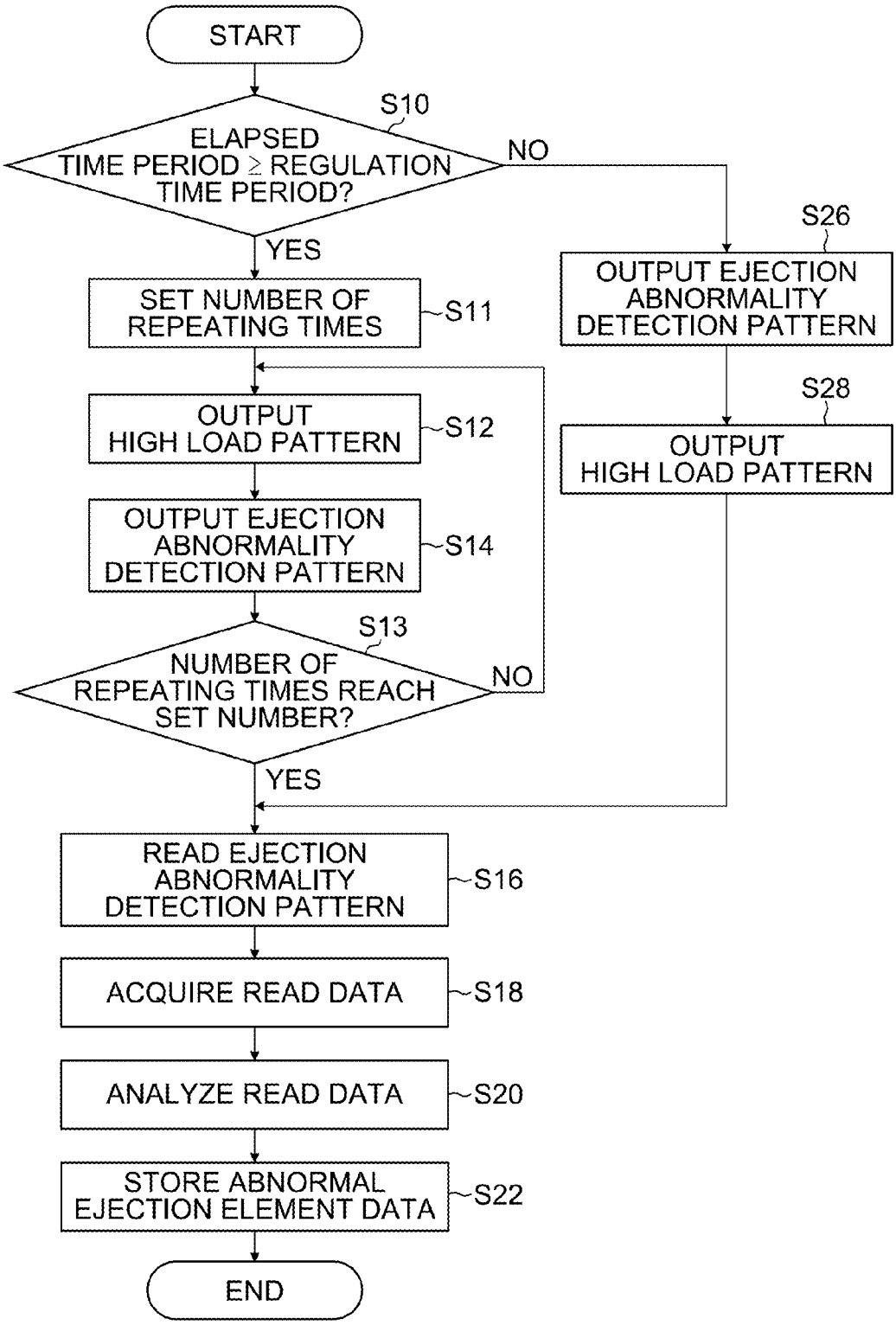
FIG. 19 is a flowchart showing a flow of an ejection abnormality detection method according to a modification example of the third embodiment of the invention.

FIG. 19 is a flowchart showing a flow of an ejection abnormality detection method according to a modification example of the third embodiment of the invention. In FIG. 19, the same step as in FIG. 2, FIG. 14 and FIG. 18 is designated by the same reference numeral and the description thereof is adequately omitted.

The flowchart shown in FIG. 19 is an example of application of the ejection abnormality detection method according to the third embodiment in a case where the same ejection abnormality detection pattern is successively output to a plurality of sheets of medium.

If determination at the elapsed time period determination step S10 is NO, that is, the elapsed time period from the outputting of the high load pattern 2 shown in FIG. 1 is less than the regulation time period, the process proceeds to the ejection abnormality detection pattern outputting step S26 in FIG. 19. At the ejection abnormality detection pattern outputting step S26, the ejection abnormality detection pattern 3 shown in FIG. 1 is output.

If the ejection abnormality detection pattern 3 shown in FIG. 1 is output at the ejection abnormality detection pattern outputting step S26 in FIG. 19, the process proceeds to the high load pattern outputting step S28 in FIG. 19. At the high load pattern outputting step S28, the ejection abnormality detection pattern 3 shown in FIG. 1 is output.

If the ejection abnormality detection pattern 3 shown in FIG. 1 is output at the high load pattern outputting step S28 in FIG. 19, the ejection abnormality detection pattern reading step S16 in FIG. 19 and the subsequent steps are performed.

If determination at the elapsed time period determination step S10 is YES, that is, the elapsed time period from the outputting of the high load pattern 2 shown in FIG. 1 exceeds the regulation time period, the high load pattern outputting step S12, the ejection abnormality detection pattern outputting step S14 and the repeating times number determining step S13 in FIG. 19 are performed. If determination at the repeating times number determining step S13 is YES, that is, the number of times performing the high load pattern 2 shown in FIG. 1 is determined to reach the number of repeating times set at the repeating times number setting step S11 in FIG. 19, the ejection abnormality detection pattern outputting step S14 and the subsequent steps are performed.

In the ejection abnormality detection described in the modification example, the ejection abnormality detection pattern 3 shown in FIG. 1 is successively output to each of a plurality of sheets of medium 100. A plurality of sheets of medium 100 may all be read out at the ejection abnormality detection pattern reading step S16 in FIG. 19, and the ejection abnormality detection patterns 3 may all be analyzed at the read data analyzing step S20. Additionally, a part of the ejection abnormality detection patterns 3 output to a plurality of sheets of medium 100 may be read out at the ejection abnormality detection pattern reading step S16, and a part of a plurality of ejection abnormality detection pattern 3 may be analyzed at the read data analyzing step S20.

The number of pieces of the read data to be analyzed is increased so as to be able to improve reliability of the ejection abnormality detection. The number of pieces of the read data to be analyzed is decreased to be able to reduce an analytical processing period in the ejection abnormality detection.

A configuration may be adopted in which the high load pattern outputting step S28 shown in FIG. 19 is also successively repeated plural times similar to the high load pattern outputting step S12.

Action and Effect According to Modification Example of Third Embodiment

According to the ejection abnormality detection method in the modification example of the third embodiment configured as described above, outputting of the high load pattern is performed plural times before outputting the ejection abnormality detection pattern, further reliably extracting the unstable ejection element, similar to the ejection abnormality detection method previously described in the third embodiment.

In addition, similar to the ejection abnormality detection method of second embodiment, in a case where the ejection abnormality detection pattern is successively output, it is possible to bring the ejection state of the inkjet head into a simulative high loaded condition in outputting the ejection abnormality detection pattern for the second and subsequent times, and to extract an unstable ejection element as an abnormal ejection element in which an abnormality does not occur under the low loaded condition but occurs under the high loaded condition, similarly to the first embodiment.

The flowcharts shown in FIG. 2, FIG. 14, FIG. 18, and FIG. 19 show a flow of the ejection abnormality detection method for one head, and in a case where a plurality of inkjet heads are provided, the above flowchart is applied to each inkjet head.

[Configuration Example of Inkjet Recording Apparatus]

Next, a description is given of an apparatus configuration example to which the ejection abnormality detection method according to the first embodiment to the third embodiment is applied. FIG. 20 is an overall configuration view of an inkjet recording apparatus in accordance with an apparatus configuration example. In the following description, the same configuration as those previously described is designated by the same reference numeral and the description thereof is adequately omitted.

The inkjet recording apparatus 10 shown in FIG. 20 is an image formation apparatus which carries out image forming on the medium 100 with an ink by means of an inkjet method.

The inkjet recording apparatus 10 is configured to include the medium serving unit 17 for feeding the medium 100, an image forming unit 60 provided with the inkjet heads 21C, 21M, 21Y, and 21K which deposit droplets of the ink of each color of the cyan ink, the magenta ink, the yellow ink, and the black ink on an image forming surface of the medium 100 to carry out image forming of a color image, and a collecting unit 70 for collecting the medium 100. The term used herein "deposit droplets" is synonymous with the term "eject".

Each of the inkjet heads 21C, 21M, 21Y, and 21K shown in FIG. 20 corresponds to the inkjet head 21 shown in FIG. 3.

The image forming unit 60 includes an image forming drum 61 for conveying the medium 100. The medium 100 is conveyed by the image forming drum 61 along a medium conveying path in the image forming unit 60.

The image forming drum 61 is formed corresponding to the maximum value of a width of the medium 100 and driven to be rotated by a motor not shown in the figure. The width of the medium refers to a length of the medium 100 in the direction perpendicular to the medium conveyance direction.

The image forming drum 61 shown in FIG. 20 rotates in a counterclockwise direction seen in FIG. 20. A rotation direction of the image forming drum 61 is shown by an arrow line in FIG. 20. The image forming drum 61 has a gripper 61G provided on an outer circumferential surface 61A thereof. The medium 100 is conveyed with a leading end thereof being gripped by the gripper 61G.

In this example, the gripper 61G is provided to each of two points on the outer circumferential surface 61A of the image forming drum 61 such that two grippers 61G are arranged at symmetrical positions with a rotary shaft 61B of the image forming drum 61 interposed therebetween. The image forming drum 61 is configured so as to convey two paper sheets in one rotation.

The outer circumferential surface 61A of the image forming drum 61 has many suction holes formed thereon. The suction hole is not shown in the figure. The medium 100 is held on the outer circumferential surface 61A of the image forming drum 61 in a state where a surface thereof opposite to the image forming surface subjected to the image forming is suctioned with vacuum through the suction holes not shown in the figure. Note that holding the medium 100 on the outer circumferential surface 61A of the image forming drum 61 is not limited to by the suction with vacuum. Electrostatic adsorption or the like may be adopted.

A transfer drum 17A is arranged between the medium serving unit 17 and the image forming unit 60. The medium 100 is conveyed by the transfer drum 17A from a stocker 17B of the medium serving unit 17 to the image forming unit 60. The transfer drum 17A includes a transfer drum body 17C constituted by a frame member and a gripper 17G provided to the transfer drum body 17C.

The transfer drum 17A is formed corresponding to the maximum value of a width of the medium and driven to be rotated by a motor not shown in the figure. The transfer drum 17A rotates in a clockwise direction seen in FIG. 20. This makes the gripper 17G rotate on the same circumference. The medium 100 is conveyed with a leading end thereof being gripped by the gripper 17G. A rotation direction of transfer drum 17A is shown by an arrow line in FIG. 20.

The medium 100 fed from the medium serving unit 17 is transferred via the transfer drum 17A to the image forming drum 61 of the image forming unit 60. The medium 100 transferred to the image forming drum 61 is sent from the image forming drum 61 of the image forming unit 60 via a chain conveyance unit 72 to the collecting unit 70.

Hereinafter, a detailed description is given of a configuration of each unit of the inkjet recording apparatus 10 according to the embodiment.

<Medium Serving Unit>

The medium serving unit 17 adjusts an attitude of the medium 100 one by one to transfer to the transfer drum 17A. The detailed configuration of the medium serving unit 17 is not shown in the figure, but configuration examples of the medium serving unit 17 include an aspect in which the stocker 17B for stocking the medium 100, a medium takeout unit for taking out the medium 100 one by one from the stocker 17B, and an attitude adjustment unit for adjusting an attitude of the medium 100 are included. The medium takeout unit and the attitude adjustment unit are not shown in the figure.

<Image Forming Unit>

The image forming unit 60 deposits droplets of each color ink of cyan, magenta, yellow, and black on the image forming surface of the medium 100 to carry out image forming of a color image on the image forming surface of the medium 100. The image forming unit 60 is configured to include the image forming drum 61 for conveying the medium 100, a paper sheet pressing roller 63 for pressing the image forming surface of the medium 100 conveyed by the image forming drum 61 to allow a surface opposite to the image forming surface of the medium 100 to be tightly contact with the outer circumferential surface 61A of the image forming drum 61, and the inkjet heads 21C, 21M, 21Y, and 21K for depositing droplets of each color ink of cyan, magenta, yellow, and black on the medium 100.

The image forming drum 61 receives the medium 100 from the transfer drum 17A and rotates to convey the medium 100. The medium 100 is conveyed in a state of being held by suction on the outer circumferential surface 61A of the image forming drum 61. The medium 100 is conveyed through the medium conveying path set along a medium conveying surface, the medium conveying surface having an arc-like surface defined by the outer circumferential surface 61A of the image forming drum 61 on an area from a medium receiving position on the image forming drum 61 to a medium receiving position on the chain conveyance unit 72. The medium conveying path travels at the center of the image forming drum 61 with respect to the direction perpendicular to the medium conveyance direction and is set so as to correspond to the medium width.

The paper sheet pressing roller 63 which is arranged in the vicinity of the medium receiving position on the image forming drum 61 receives a pressing force applied by a pressing mechanism not shown in the figure so as to be pressed and abutted against the outer circumferential surface 61A of the image forming drum 61. The medium 100 transferred from the transfer drum 17A to the image forming drum 61 is passed to be nipped between the paper sheet pressing roller 63 and the outer circumferential surface 61A of the image forming drum 61, and a surface opposite to the image forming surface of the medium 100 is brought into tightly contact with the outer circumferential surface 61A of the image forming drum 61.

The inkjet heads 21C, 21M, 21Y, and 21K for depositing droplets of each color ink of cyan, magenta, yellow, and black are arranged at a constant interval along the medium conveying path. The inkjet heads 21C, 21M, 21Y, and 21K each are a line head corresponding to the maximum value of the width of the medium 100 and eject the ink from a plurality of nozzles formed on the ejection surface toward the medium 100.

The ejection surface which is a surface of each of the inkjet heads 21C, 21M, 21Y, and 21K facing the outer circumferential surface 61A of the image forming drum 61 is a surface functioning as an ejection surface for ejecting an ink.

The image forming of a color image is made on the image forming surface of the medium 100 by the ink ejected from the inkjet heads 21C, 21M, 21Y, and 21K.

<Collecting Unit>

The collecting unit 70 collects and stacks on a stacker 71 the medium 100 having been subjected to a series of image forming processing. The collecting unit 70 is configured to include the stacker 71 on which the medium 100 is collected, the chain conveyance unit 72 for receiving and discharging the medium 100 from the image forming unit 60 to the stacker 71, and a guide 73 for supporting the medium 100 conveyed by the chain conveyance unit 72.

The chain conveyance unit 72 includes two chains 72A arranged along the direction perpendicular to the medium conveyance direction. A plurality of grippers 72G are arranged between two chains 72A along the direction perpendicular to the medium conveyance direction. FIG. 20 shows one of two chains 72A.

Further, a plurality of gripper groups each constituted by a plurality of grippers 72G along the direction perpendicular to the medium conveyance direction are arranged along the medium conveyance direction. FIG. 20 shows only one of the plural grippers 72G constituting each gripper group.

A group of the grippers which are arranged along the direction perpendicular to the medium conveyance direction grips a leading end of one sheet of medium 100.

Note that a configuration of the inkjet recording apparatus is not limited to the embodiment. For example, an aspect may be adopted in which a pre-process unit is provided, at a stage prior to the image forming unit 60, for conducting a pre-process on the image forming surface of the medium 100 before subjected to the image forming. Examples of the pre-process include an application of a treatment liquid for aggregating or insolubilizing a coloring material contained in the ink, a drying process for the treatment liquid, a heating process for the medium 100, and the like.

Additionally, an aspect may be adopted in which a post-process unit is provided, at a stage subsequent to the image forming unit 60, for conducting a post-process. Examples of the post-process include a fixing process for the medium 100 after the image forming, a drying process for the medium 100 after the image forming, and the like.

<Structure of Inkjet Head>

FIG. 21 is a perspective plan view showing a structural example of an inkjet head.

The inkjet head 21 shown in FIG. 21 has a structure in which a plurality of head modules 200 are linked in the direction perpendicular to the medium conveyance direction.

A plurality of head modules 200 constituting the inkjet head 21 may have the same structure adopted. Moreover, the head module 200 singularly can be made to function as an inkjet head.

The inkjet head 21 shown in FIG. 21 has a structure in which a plurality of head modules 200 are aligned along the direction perpendicular to the medium conveyance direction and is a full line type inkjet head having a plurality of ejection elements arranged across a length corresponding to the maximum value $L_{max}$ of the width of the medium 100. The ejection element is not shown in FIG. 21.

This example illustrates the inkjet head 21 having the structure in which a plurality of head modules 200 are aligned along the direction perpendicular to the medium conveyance direction, but a plurality of head modules 200 may be arranged in a staggered fashion in the direction perpendicular to the medium conveyance direction or a plurality of head modules 200 may be formed into one body structure.

Figure 22:
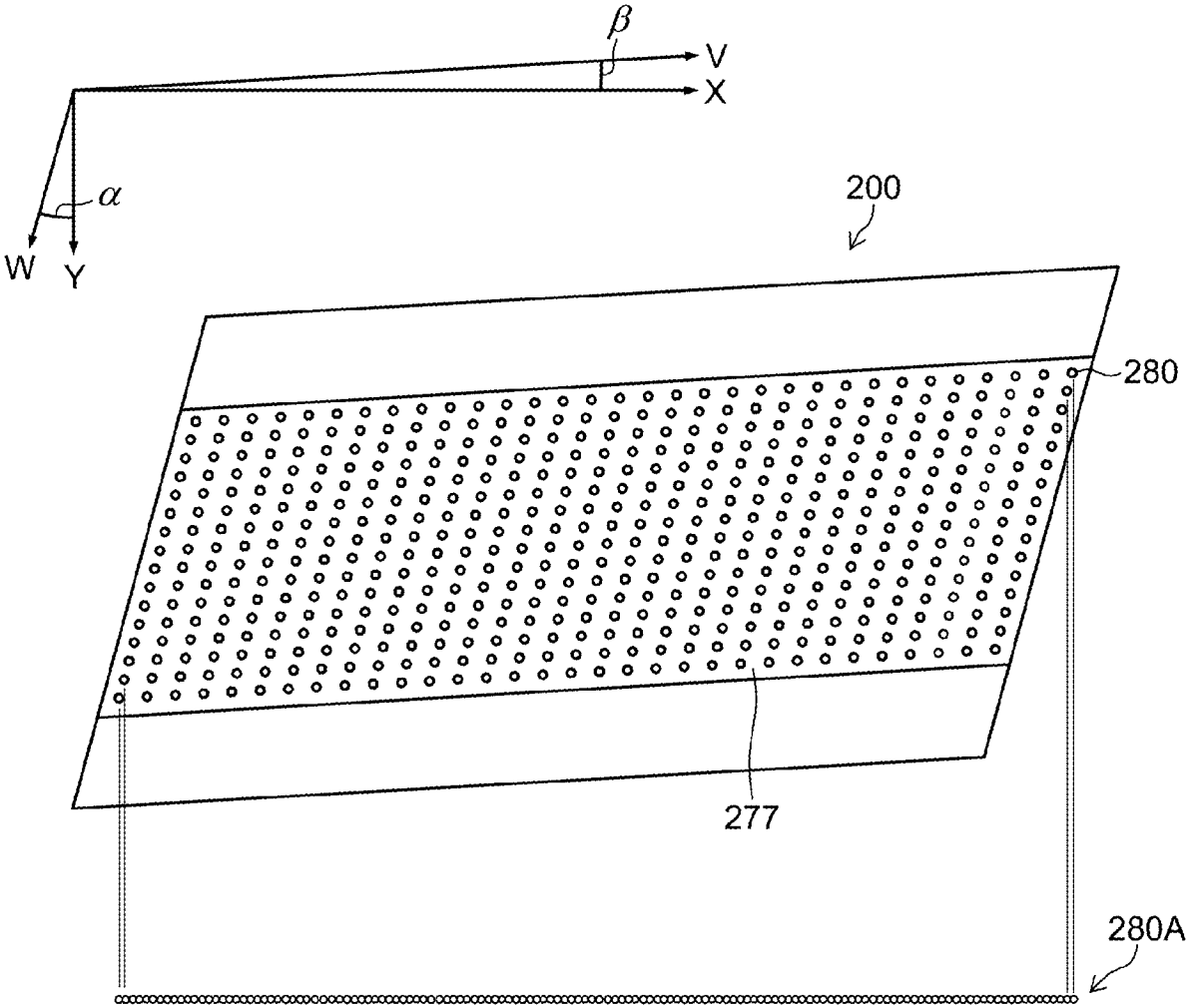
FIG. 22 is a plan perspective view of an ejection surface of a head module.

FIG. 22 is a plan perspective view of an ejection surface of a head module. FIG. 22 illustrates with reducing the number of nozzle openings 280 arranged on an ejection surface 277, but the ejection surface 277 of one head module 200 has a plurality of nozzle openings 280 two-dimensionally arranged thereon.

The head module 200 has a planar shape of a parallelogram in which an end face on a long side is along a V direction inclined by an angle β with respect to the direction perpendicular to the medium conveyance direction and an end face on a short side is along a W direction inclined by an angle α with respect to the medium conveyance direction, and plurality of nozzle openings 280 are arranged in a matrix arrangement in a row direction along the V direction and a column direction along the W direction.

The arrangement of the nozzle openings 280 is not limited to an aspect shown in FIG. 22, and a plurality of nozzle openings 280 may be arranged in a row direction along the direction perpendicular to the medium conveyance direction and in a column direction obliquely crossing the direction perpendicular to the medium conveyance direction.

The matrix arrangement of the nozzle openings 280 refers to an arrangement of the nozzle openings 280 in a projected nozzles row 280A in which an arrangement interval between the nozzle openings 280 and a distance between the nozzles are respectively uniform, the projected nozzles row 280A being to be obtained by projecting a plurality of nozzle openings 280 in the direction perpendicular to the medium conveyance direction to arrange the plurality of nozzle openings 280 along the direction perpendicular to the medium conveyance direction.

In the projected nozzles row in the direction perpendicular to the medium conveyance direction, at a linked portion of the head modules 200 adjacent to each other, the nozzle opening 280 belonging to one head module 200 and the nozzle opening 280 belonging to the other head module 200 are mixed.

If the respective head modules 200 have no installation position error, the nozzle opening 280 belonging to one head module 200 and the nozzle opening 280 belonging to the other head module 200 at a linked region are arranged at positions the same in the direction perpendicular to the medium conveyance direction in the projected nozzles row, and thus, the arrangement of the nozzle openings 280 is uniform also at the linked region.

Figure 23:
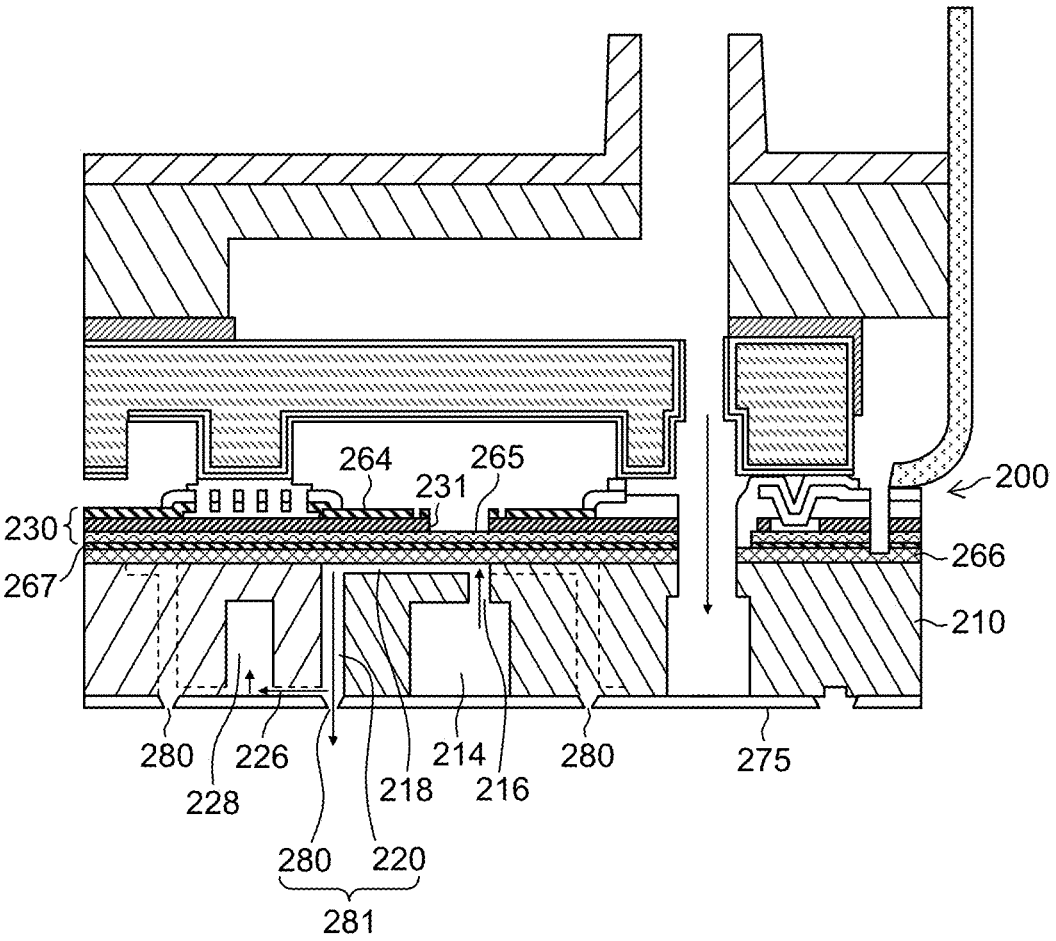
FIG. 23 is a cross-sectional view showing an internal structure of an inkjet head.

FIG. 23 is a cross-sectional view showing an internal structure of an inkjet head. A reference numeral 214 designates an ink supply channel, reference numeral 218 designates a pressure chamber, reference numeral 216 designates an individual supply channel connecting each pressure chamber 218 with an ink supply channel 214, reference numeral 220 designates a nozzle communicating channel continuous from the pressure chamber 218 to a nozzle opening 280, and reference numeral 226 designates a circulating individual flow channel connecting the nozzle communicating channel 220 with the circulating common flow channel 228. The pressure chamber 218 may be called a liquid chamber in some cases.

These flow channel units 214, 216, 218, 220, 226, and 228 constitute a flow channel structure 210, on which a diaphragm 266 is provided. Provided on the diaphragm 266 via a bonding layer 267 is a piezo element 230 having a layered structure including a lower electrode 265, a piezoelectric body layer 231, and an upper electrode 264. The lower electrode 265 may be called a common electrode and the upper electrode 264 may be called an individual electrode in some cases.

The upper electrode 264 is an individual electrode patterned corresponding to a shape of each pressure chamber 218 and each pressure chamber 218 is respectively provided with the piezo element 230.

The ink supply channel 214 is connected with an ink supply chamber not shown in the figure and the ink is supplied from the ink supply channel 214 via the individual supply channel 216 to the pressure chamber 218. When a drive voltage is applied depending on the input image data to the upper electrode 264 of the piezo element 230 provided to the corresponding pressure chamber 218, the relevant piezo element 230 and diaphragm 266 deform, thereby changing the volume of the pressure chamber 218. This causes a pressure change which results in ink being ejected via the nozzle communicating channel 220 from the nozzle opening 280.

The piezo element 230 is controlled to drive corresponding to each nozzle opening 280 depending on dot arrangement data generated from the input image data, which allows the ink to be ejected from the nozzle opening 280.

While the medium 100 is conveyed at a constant speed in the medium conveyance direction, a timing of ejecting the ink from each nozzle opening 280 is controlled to be adjusted to the conveyance speed, which allows a desired image to be recorded on the medium 100.

The pressure chamber 218 provided to correspond to each nozzle opening 280 has a substantially square planar shape not shown in the figure, an outlet port to the nozzle opening 280 being provided in one corner of a diagonal of the pressure chamber, and the individual supply channel 216 as an inlet port being provided in the other corner thereof.

Note that the shape of the pressure chamber is not limited to a square. The planar shape of the pressure chamber may adopt various modes including a quadrilateral shape such as diamond shape, rectangular shape, or the like, a pentagonal shape, a hexagonal shape, or other polygonal shape, or a circular shape, elliptical shape, or the like.

A circulation outlet port not shown in the figure is formed in a nozzle unit 281 including the nozzle opening 280 and the nozzle communicating channel 220, and the nozzle unit 281 communicates via the circulation outlet port with the circulating individual flow channel 226.

Of the ink in the nozzle communicating channel 220 and the nozzle opening 280, ink not used for droplet deposition is collected via the circulating individual flow channel 226 into the circulating common flow channel 228.

The circulating common flow channel 228 is connected with an ink circulating chamber not shown in the figure, and the ink is always collected through the circulating individual flow channel 226 into the circulating common flow channel 228, the ink near the nozzle opening 280 can be prevented from thickening when not ejecting the ink.

Examples of the inkjet head 21 described above include a configuration of 17 head modules 200 being aligned along the direction perpendicular to the medium conveyance direction. Moreover, examples of the head module 200 include a configuration provided with 2048 recording elements.

The "ejection element" which is the minimum unit of a configuration for ink droplet deposit includes one nozzle unit 281, and a flow channel such as the pressure chamber 218 communicating with the nozzle unit 281 and the piezo element 230 corresponding to the nozzle unit 281.

Examples of the piezo element include the piezo element 230 having a configuration which is individually separated corresponding to the nozzle opening 280 in FIG. 22. Of course, a configuration may be adequately adopted in which the piezoelectric body layer 231 is formed integrally for a plurality of nozzle units 281, the individual electrode is formed corresponding to each nozzle unit 281, and an active region is formed for each nozzle unit 281.

A thermal method may be adopted in which a heater as a pressure generating element is provided inside the pressure chamber 218 in place of the piezo element, the drive voltage is supplied to the heater to generate heat, and a film boiling phenomenon is used so that the ink in the pressure chamber 218 is ejected from the nozzle opening 280.

[Medium]

The medium includes those called various terms such as a record medium, recording medium, print medium, printing medium, image formation medium, image forming medium, image receiving medium, ejection receiving medium, paper sheet, recording paper, print sheet, board, and the like.

Combination of Embodiments

The configurations obtained by appropriately combining the above described embodiments and modification examples may be used.

Example Applied to Program Invention

An invention of a program or a non-transitory tangible computer-readable recording medium for storing the program may be constituted that includes the devices which correspond to the respective units of the apparatus and respective steps described above. In other words, an ejection detecting program which may be stored in the recording medium may be constituted that includes the devices which correspond to the respective steps of the ejection abnormality detection method according to the first embodiment or the devices which correspond to the respective units of the inkjet recording apparatus according to the first embodiment, and that causes a computer to execute as the respective devices.

In the embodiments and modification examples of the present invention described above, the configuration requirements may be appropriately changed, added or deleted without departing from the scope of the present invention. The present invention is not limited to the above described embodiments, but may be variously modified by a person having ordinary skill in the art within the technical idea of the present invention.

What is claimed is:

1. An ejection abnormality detection method, comprising:

a high load pattern outputting step of ejecting a liquid which has a volume exceeding a volume for forming a dot of a maximum size used in regular liquid ejection to output a high load pattern;

an ejection abnormality detection pattern outputting step of outputting an ejection abnormality detection pattern for detecting an ejection element abnormality within a specific period of time from outputting the high load pattern in the high load pattern outputting step;

a read data acquiring step of acquiring read data of the ejection abnormality detection pattern output in the ejection abnormality detection pattern outputting step; and an analyzing step of analyzing the read data acquired in the read data acquiring step to detect an abnormal ejection element.

2. The ejection abnormality detection method according to claim 1, wherein in the ejection abnormality detection pattern outputting step, the ejection abnormality detection pattern is successively output plural times, and in the analyzing step, a part or all of the read data of a plurality of ejection abnormality detection patterns output in the ejection abnormality detection pattern outputting step are analyzed.

3. The ejection abnormality detection method according to claim 1, wherein in the high load pattern outputting step, the high load pattern is constituted by a dot formed of a liquid having a volume of 60% or more of a maximum ejection volume which can be ejected from a liquid ejection head that is an object of ejection abnormality detection.

4. The ejection abnormality detection method according to claim 1, wherein in the high load pattern outputting step, the high load pattern is constituted by a dot formed of a liquid having a volume of 1.25 times or more the liquid having the volume for forming the dot of the maximum size used in the regular liquid ejection.

5. The ejection abnormality detection method according to claim 1, wherein in the analyzing step, the high load pattern is not an object of analysis, and the ejection abnormality detection pattern is an object of analysis.

6. The ejection abnormality detection method according to claim 1, wherein in the high load pattern outputting step, in a case where a plurality of liquid ejection heads are objects of ejection abnormality detection, the high load pattern of each of the plurality of liquid ejection heads is output to the same region on a medium.

7. The ejection abnormality detection method according to claim 1, wherein in the high load pattern outputting step, in a case where a plurality of liquid ejection heads are objects of ejection abnormality detection, the high load pattern of each of the plurality of liquid ejection heads is output to a different region on a medium.

8. The ejection abnormality detection method according to claim 1, further comprising an elapsed time period determination step of determining whether or not an elapsed time period from outputting of a previous high load pattern exceeds a predefined regulation time period, wherein in the high load pattern outputting step, in a case where the elapsed time period from outputting of the previous high load pattern is determined to exceed the predefined regulation time period in the elapsed time period determination step, the high load pattern is output.

9. The ejection abnormality detection method according to claim 1, further comprising an elapsed time period determination step of determining whether or not an elapsed time period from outputting of a previous high load pattern exceeds a predefined regulation time period, wherein in the ejection abnormality detection pattern outputting step, in a case where the elapsed time period from outputting of the previous high load pattern is determined to be the predefined regulation time period or less in the elapsed time period determination step, the ejection abnormality detection pattern is output, in the high load pattern outputting step, in a case where the elapsed time period from outputting of the previous high load pattern is determined to exceed the predefined regulation time period in the elapsed time period determination step, the high load pattern is output, and in a case where the elapsed time period from outputting of the previous high load pattern is determined to be the predefined regulation time period or less in the elapsed time period determination step, the high load pattern is output after the ejection abnormality detection pattern outputting step.

10. The ejection abnormality detection method according to claim 1, wherein in the ejection abnormality detection pattern outputting step, the ejection abnormality detection pattern is output to a same medium as a medium to which the high load pattern is output in the high load pattern outputting step.

11. The ejection abnormality detection method according to claim 1, wherein in the ejection abnormality detection pattern outputting step, the ejection abnormality detection pattern is output to a medium immediately following a medium to which the high load pattern is output in the high load pattern outputting step.

12. A liquid ejection device, comprising:

a liquid ejection head provided with an ejection element for ejecting a liquid;

a high load pattern data generation device which ejects a liquid that has a volume exceeding a volume for forming a dot of a maximum size used in regular liquid ejection to generate high load pattern data in outputting a high load pattern;

an ejection abnormality detection pattern data generation device which generates ejection abnormality detection pattern data in outputting an ejection abnormality detection pattern for detecting an ejection element abnormality;

a read data acquisition device which acquires read data of the ejection abnormality detection pattern output from the liquid ejection head;

an analysis device which analyzes the read data acquired by the read data acquisition device to detect an abnormal ejection element; and an ejection control device which controls liquid ejection of the liquid ejection head based on the high load pattern data generated by the high load pattern data generation device in outputting the high load pattern from the liquid ejection head, and controls liquid ejection of the liquid ejection head based on the ejection abnormality detection pattern data generated by the ejection abnormality detection pattern data generation device within a specific period of time from outputting the high load pattern in outputting the ejection abnormality detection pattern from the liquid ejection head.

13. A non-transitory tangible computer-readable recording medium including an ejection abnormality detection program for a liquid ejection device which includes a liquid ejection head provided with an ejection element for ejecting a liquid, stored thereon, the program causing a computer to function as:

a high load pattern data generation device which ejects a liquid that has a volume exceeding a volume for forming a dot of a maximum size used in regular liquid ejection to generate high load pattern data in outputting a high load pattern;

an ejection abnormality detection pattern data generation device which generates ejection abnormality detection pattern data in outputting an ejection abnormality detection pattern for detecting an ejection element abnormality;

a read data acquisition device which acquires read data of the ejection abnormality detection pattern output from the liquid ejection head;

an analysis device which analyzes the read data acquired by the read data acquisition device to output an abnormal ejection element; and an ejection control device which controls liquid ejection of the liquid ejection head on the basis of the high load pattern data generated by the high load pattern data generation device in outputting the high load pattern from the liquid ejection head, and controls liquid ejection of the liquid ejection head on the basis of the ejection abnormality detection pattern data generated by the ejection abnormality detection pattern data generation device within a specific period of time from outputting the high load pattern in outputting the ejection abnormality detection pattern from the liquid ejection head.

* * * * *